US005994833A

United States Patent [19]

Seko et al.

[11] Patent Number: 5,994,833

[45] Date of Patent: Nov. 30, 1999

[54] FIELD EMISSION COLD CATHODE APPARATUS HAVING A HEATER FOR HEATING EMITTERS TO DECREASE ADSORPTION OF A GAS INTO THE EMITTERS

[75] Inventors: Nobuya Seko; Hironori Imura, both of Tokyo, Japan

[73] Assignee: NEC Corporation, Tokyo, Japan

[21] Appl. No.: 08/990,430

[22] Filed: Dec. 15, 1997

[30] Foreign Application Priority Data

Dec. 16, 1996 [JP] Japan ..... 8-335608

[51] Int. Cl.[6] ..... H01J 1/30; H05B 37/00

[52] U.S. Cl. ..... 313/495; 313/309; 313/310; 315/169.3

[58] Field of Search ..... 313/495, 309, 313/336, 351, 355, 422, 310; 315/169.1, 169.3, 94

[56] References Cited

U.S. PATENT DOCUMENTS

| | | | |
|---|---|---|---|
| 4,551,650 | 11/1985 | Noda et al. | 313/16 |
| 5,449,968 | 9/1995 | Terui et al. | 313/336 |

FOREIGN PATENT DOCUMENTS

| | | |
|---|---|---|
| 64-54639 | 3/1989 | Japan . |
| 4-22038 | 1/1992 | Japan . |
| 4-229922 | 8/1992 | Japan . |
| 4-308626 | 10/1992 | Japan . |
| 4-370635 | 12/1992 | Japan . |
| 5-198255 | 8/1993 | Japan . |
| 5-266787 | 10/1993 | Japan . |
| 6-223705 | 8/1994 | Japan . |
| 6-310024 | 11/1994 | Japan . |
| 7-182969 | 7/1995 | Japan . |
| 10-208649 | 8/1998 | Japan . |

*Primary Examiner*—Nimeshkumar D. Patel
*Assistant Examiner*—Joseph Williams
*Attorney, Agent, or Firm*—Sughrue, Mion, Zinn, Macpeak & Seas, PLLC

[57] ABSTRACT

In this field emission cold cathode apparatus, the heater shares at least one terminal with the other components, namely, the emitter electrode, the gate electrode, the focus electrode. With this structure, gases absorbed into a surface of the emitters can be released out from the emitters, by heating emitters with the heater. In addition, this apparatus can avoid the increase in the number of the terminal compared with the conventional apparatus having a heater.

28 Claims, 29 Drawing Sheets

FIELD EMISSION COLD CATHODE APPARATUS HAVING A HEATER FOR HEATING EMITTERS TO DECREASE ADSORPTION OF A GAS INTO THE EMITTERS

BACKGROUND OF THE INVENTION

This invention relates to a field emission cold cathode apparatus which has an emitter electrode and a gate electrode and which emits electron beams from emitters included in the emitter electrode. In particular, this invention relates to the field emission cold cathode apparatus comprising a heat radiating unit (or a heater) for decreasing adsorption of a gas into the emitters and, furthermore, to a display apparatus including the field emission cold cathode apparatus and a voltage supplying unit for driving the field emission cold cathode apparatus.

A field emission cold cathode apparatus of the type described comprises an emitter electrode and a gate electrode as main components and emits, by the tunnel effect, electron beams from a surface of emitters included in the emitter electrode without heating the emitters up. In the field emission cold cathode apparatus, a tunnel effect occurs in the emitter electrode, when the emitter electrode is given a predetermined negative potential relative to a potential of the gate electrode provided as a referential potential. This tunnel effect is caused to occur such that electrons are released out from the surface thereof. Thus, it is noted that electron-emission depends not on a temperature of each emitters but on a difference of voltages between the gate electrode and the emitters, namely, the emitter electrode.

Specifically, the emitter electrode has a substrate of a semiconductor or a conductor and a plurality of emitters arrayed on the substrate.

In general, electron beams emitted from the above apparatus mainly depend on the electric-field intensity at points of emitters. It is preferable that the electron beams have high current density by generating high field intensity. On the other hand, it is desirable that a voltage difference between the emitter electrode and the gate electrode is as small as possible. To this end, each of the emitters has a conical shape having a needle-like tip or apex.

The gate electrode is located in the vicinity of each emitter and has a plurality of holes, each of which surrounds the each emitter. Practically, a minimum distance between the tip of the emitter and the gate electrode is as small as one micron meter. With this structure, the gate electrode is supplied with a higher potential relative to the emitter electrode and serves to concentrate the electric field on the points of the emitters no as to extract or emit the electron beams from the emitters.

Furthermore, such a field emission cold cathode apparatus may comprise a focus electrode for focusing the electron beams extracted by the gate electrode and emitted from the emitters. The focus electrode is located above the gate electrode or around an outer periphery of the sate electrode.

In this structure, it is assumed that the focus electrode is supplied with a potential lower than the gate electrode. In this case, expansion of the electron beams extracted by the gate electrode can be avoided in dependency upon a difference of voltages between the focus electrode and the gate electrode.

This apparatus has a common problem that gas molecules are absorbed onto the surface of the emitters during emission of electrons. Gas molecules exit in a receptacle or chamber which accommodates this apparatus and which is kept at a low vacuum. In other cases when emitted electrons bombard components such as the gate electrode, an insulator surrounding the emitters an anode, and an inner wall of the receptacle, the gas molecules absorbed into the surfaces of the emitters are partially desorbed form in the form of ions. Such absorption of gas into the emitters undesirably increases a work function as regards electron-emission. In order to desirably continue emission of electrons from the emitters, the electric-field intensity must be maintained sufficiently high so that such absorption of gas into the emitters does not take place.

A conventional field emission cold cathode, which has an object solving the above problem, is disclosed in Japanese Unexamined Patent Publication (JP-A) Nos. 370635/92, 22038/92, 198255/93, 182969/95, 223705/96, 54639/89, and 310024/96.

JP-A No. 370635/92 provides a technique to decrease absorption of gas into emitter's surface in an image display device, by continuously or intermittently supplying emitters with a positive potential during no supply of the negative potential.

JP-A No. 22038/92 discloses a technique of dividing an emitter array into two groups of emitters. In this event, one group of emitters is kept at a potential higher than a gate electrode corresponding to the remaining one of groups during emission of electrons from the remaining one group, so that the electrons emitted from the remaining one group collide with the one group emitters and clean one group of emitters.

JP-A No. 198255/93 is an improvement of JP-A No. 22038/92 mentioned above and discloses a technique for supplying an anode with a negative potential during the cleaning of the one group of emitters. This technique is helpful to guide the electrons emitted from the remaining one group only onto the one group of the emitters.

All of the above mentioned conventional techniques, JP-A Nos. 370635/92, 22038/92, and 198255/93, make use of the electrodes basically included in the field emission cold cathode apparatus.

However, only making use of the basic electrode, prevention or restraint of absorbing gases can not be desirably accomplished.

The other conventional techniques, JP-A Nos. 182969/95, 223705/96, 54639/89, and 310024/96, disclose the way how to prevent or suppress absorption of a gas into surface of the emitters. Detailed contents of the techniques will be discussed below.

JP-A No. 182969/95 discloses a technique of heating a plurality of emitters with a heater formed under the emitter electrode having the emitters. This technique serves to effectively release molecule gases absorbed into the surface of emitters from the emitters.

JP-A No. 223705/96 provides a technique of causing a current to flow into a substrate. In this event, the substrate has a part which is located under the emitters and which is thin compared with other parts. With this structure, only the thin part of the substrate under the emitters is heated up when the current flows into the thin part. This structure also serves to desorb gases absorbed into the surface of the emitters.

JP-A No. 54239/89 proposes a method of releasing molecule gases absorbed into the surface of emitters from the emitters. In this method, the emitters are heated with a heater which is located on the same layer as the gate electrode and which surrounds a region of the emitters, namely, an emitter area.

JP-A No. 310024/96 suggests a technique of heating emitters up to release molecule gases absorbed into surfaces of emitters which are included in a part of a filament member. In this technique, a current is caused to flow between two electrodes.

However, the above-mentioned techniques or methods are disadvantageous in common in that the heater should be driven by a power supply which is independent of the power supply for driving the remaining components included in the apparatus.

Moreover, the technique provided in JP-A No. 223705/96 brings about complicated processes as a whole and a high cost, because a further process for deeply etching the back surface of the substrate is necessary in addition to the usual processes.

The technique proposed in JP-A No. 54239/89 has a problem that the heater surrounding the emitter area makes it difficult to form a member for attaining a focusing effect. In order to attain a good focusing effect, a focus electrode is often arranged to avoid expansion of electron beams emitted from the emitter and is located above the gate electrode or around an outer periphery of the gate electrode. With this structure, the focus electrode surrounds the emitter area. The focusing effect results from generation of an electric-field while the focus electrode is supplied with the negative potential. The emitted electron beams are guided by the focusing effect toward the anode. Therefore, it is preferable that the focus electrode is put in the vicinity of the emitter area, popularly, on the region surrounding the emitter area. However, the region surrounding the emitter area is occupied by the heater in JP-A 54239/89.

Consequently, the focus electrode and the like is restricted to a remote region except the region surrounding the emitter area. Thus. it is difficult for the structure of JP-A 54239/89 to attain a desirable focusing effect.

The technique suggested in JP-A No. 310024/96 has a complicated structure and cannot make use of the other conventional structures.

In addition, the other conventional techniques, JP-A Nos. 182969/95, 223705/96, 54639/89, and 310024/96, have a common drawback such that the number of terminals is inevitably increased to connect the heater to an independent terminal. Description about the above-mentioned drawbacks will be detailed.

A field emission cold cathode apparatus must have terminals connected to the electrodes and extended to the outside of the receptacle or housing which accommodates this apparatus. A field emission cold cathode apparatus acts in a vacuum, as atmosphere well-known manner. Actually using this apparatus, the receptacle is necessary to hold this apparatus in a vacuum. And, to supply the electrodes with potentials, the terminals should be extended to the outside of the receptacle.

As well known, spaces and locations for the terminals are limited by the structures relating to a size and the shape of the receptacle, such as a CRT and so on.

As understood above, to increase the number of terminals extended to the outside of the receptacle results in limitation of the space as mentioned above and shortens a distance between the terminals.

Practically, the limited space restricts the number of the extended terminals to an allowable degree, because a narrow distance between the terminals makes an electrical insulation characteristic worse.

However, no consideration is made at all in all of the other conventional techniques about the number of the terminals. In addition, no disclosure is also made about the problem which might take place when the number of the terminals increases.

Furthermore, costs of the apparatus undesirably becomes high as the number of the terminals increases. Herein, consideration is made about an electron tube which has a receptacle of ceramics. In this event, each terminals must be extended to the outside of the receptacle, which gives use to a lot of troubles. In addition, an increase of the terminals results in an increase of wires connected to the terminals. Such wiring process is time-consuming and costly because wire-bonding and welding are carried out. Just for reference, costs for the wiring process become very high as a single terminal is added when a TWT (Traveling-Wave Tube) is manufactured which is utilized in microwave range.

SUMMARY OF THE INVENTION

It is therefore an object of this invention to provide a field emission cold cathode apparatus with a heater, which is inexpensive as compared with a conventional apparatus.

It is another object of this invention to provide the field emission cold cathode apparatus of the type described, which can reduce terminals in number event when the heater is located therein.

It is still another object of this invention to provide the field emission cold cathode apparatus of the type described, which can avoid contamination of emitters.

To achieve these objects, this invention provides a field emission cold cathode apparatus having some features. Namely, the heater and the other component share one terminal in the field emission cold cathode apparatus. On the other hand, a single component which is used as a part of the apparatus may also be operable as a heater. To be concrete, a heater included in this apparatus shares at least one terminal with a selected one of the emitter electrode, the gate electrode, and the focus electrode. In this event, the selected one of the emitter electrode and the focus electrode forms a part of a resistor region, and therefore serves as the heater when a current is caused to flow through the resistor region. By using a bipolar-voltage supplying device, the heater is heated when the emitters are kept in inactive states. The heater may be driven while the bipolar voltage takes either both polarities or a selected polarity.

The following can be understood from the above features of this apparatus. First, an increase of terminals is held minimum when the heater is located, because the heater shares one terminal with the other components basically included in this apparatus. Second, processes of manufacturing the apparatus are simple comparison with those in the conventional methods, because of making use of the other basic components as the heater. Third, this apparatus can effectively clean the emitters when the emitters are intermittently put in an inactive state.

DESCRIPTION OF THE PREFERRED EMBODIMENT

A field emission cold cathode apparatus of this invention possesses a feature that a heater shares one terminal with another component therein, especially with a component supplied with a potential.

The field emission cold cathode apparatuses according to this invention can be classified into two types. One type is that the heater shares one terminal with an emitter electrode or agate electrode, while another type is that the heater shares the terminal with a focus electrode or a gate electrode. Of course, the former includes the case where two ends of the heater are connected to an emitter terminal and a gate terminal which are used in common with the emitter electrode and the gate electrode, respectively. While the latter includes the case where two ends of the heater are connected to the gate terminal and the focus terminal which are used in common with the gate electrode and the focus electrode, respectively. Now, the former will be described in conjunction with each of first through sixth embodiments below while the latter will be mentioned with reference to each of seventh through tenth embodiments below.

A field emission cold cathode apparatus according to the first embodiment of this invention possesses two features. The first one of the features is that two connection ends 31, 32 are connected in common to a gate terminal 22 and an emitter terminal 12, respectively, in FIG. 1. The second feature is that a bipolar-voltage is impressed between the gate and emitter terminal 12, 22, and the heater is driven by supply of positive and negative potentials relative to a gate potential while electrons are emitted from the emitters given a negative potential, in FIG. 2. The following explanation makes these features clear with reference to FIGS. 1 to 3.

Figure 1:
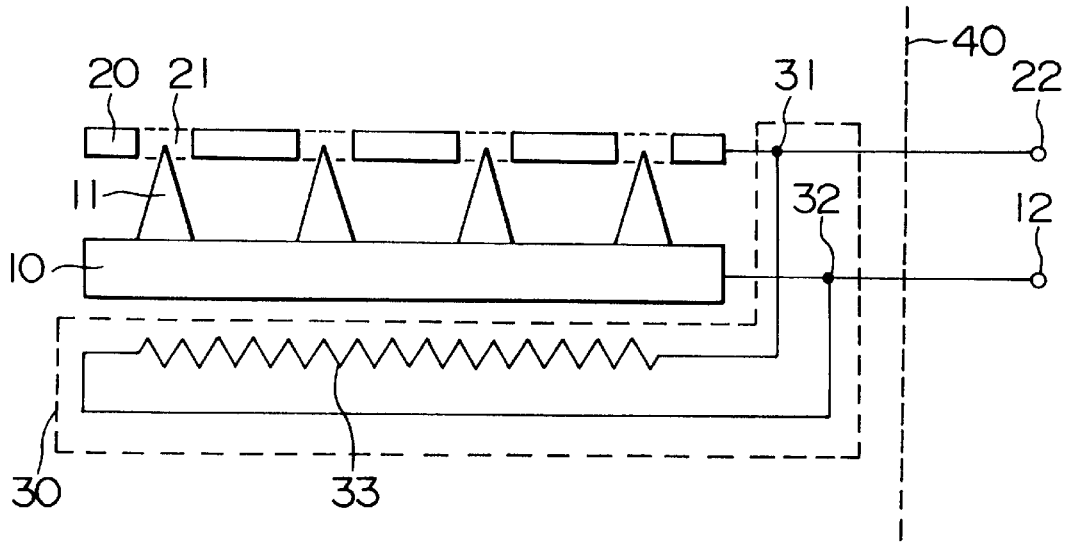
FIG. 1 is a view illustrating a field emission cold cathode apparatus according to the first embodiment of the present invention.

The field emission cold cathode apparatus of the first embodiment comprises an emitter electrode 10, a gate electrode 20, and a heater 30, as shown in FIG. 1.

The emitter electrode 10 has a plurality of emitters 11, each having a needle-like point, such as a conical shape, and is connected to an emitter terminal 12 extended to the outside of a receptacle or housing of the apparatus. Further, a boundary between the receptacle and the outside thereof is shown by a broken line 40 in FIG. 1. The emitter electrode 10 is supplied through the emitter terminal 12 with a negative potential relative to a gate potential given to the gate electrode 20 during emission of electrons (or electron beams).

The gate electrode 20 has a plurality of holes 21 utilized in generating high electric-field at the points of the emitters 11, and is connected to agate terminal 22 extended to the outside of the receptacle. The gate electrode 20 is supplied with the gate potential as a reference potential through the gate terminal 22. Further, the gate electrode 20 is supported above the emitter electrode 10 by an insulator layer (a thin film: not shown) formed on the emitter electrode 10, like in the conventional apparatus.

The heater 30 has two connection ends (heater ends) 31, 32, and a resistor 33 located between the two connection ends 31, 32.

Figure 2:
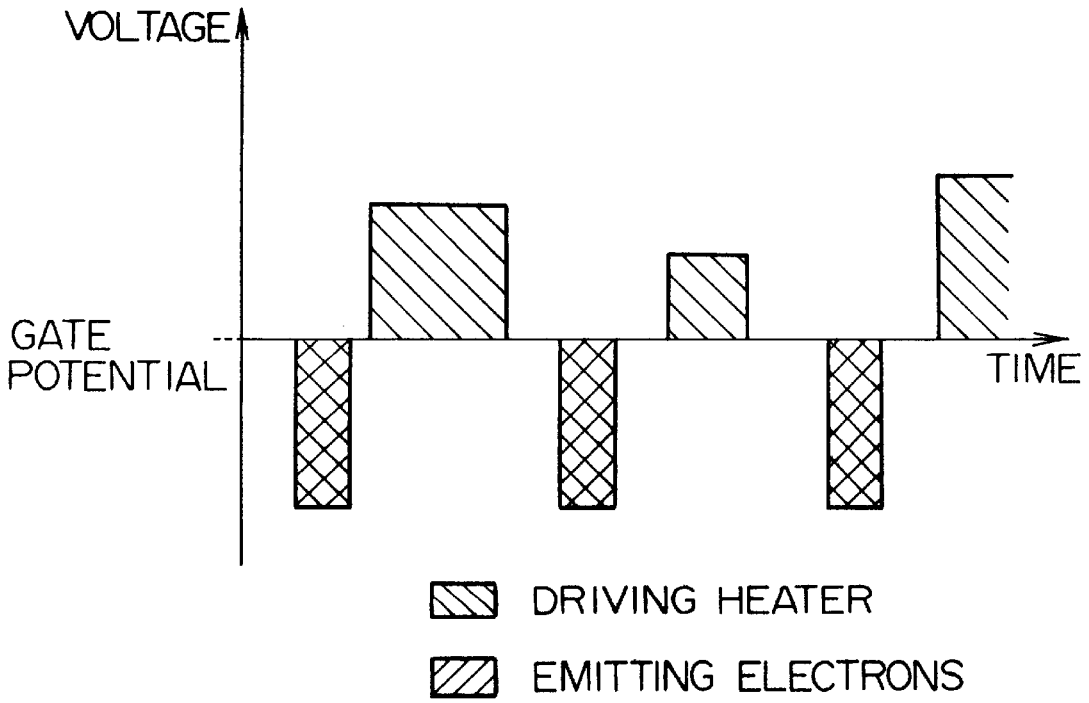
FIG. 2 is a graph view illustrating a variation of voltage value from the gate terminal to the emitter terminal shown in FIG. 1.

To drive the field emission cold cathode apparatus of this embodiment, a bipolar-voltage is applied between the emitter terminal 12 and the gate terminal 22. FIG. 2 shows a variation of the potential given to the emitter terminal 12 in relation to the reference potential given to the gate terminal 22. Further, a pulse, which is hatched by lines slanted downwards on the right-hand side of this figure, causes the heater 30 to radiate heat, by a current flowing into the resistor 23, in FIGS. 1, 2. While another pulse, which is hatched by lines slanted upwards on the right-hand side, causes the electrons to be emitted from the emitter 11, by supplying the emitter electrode 10 with negative potential, in FIG. 2. Thus, electrons are emitted at the time of driving the heater 30 with the negative potential supplied to the emitter terminal 12, while the heater 30 alone is driven with the positive potential supplied to the emitter terminal 12.

As understood above, the receptacle, including this apparatus therein, employs a bipolar-voltage supplying unit (not shown) as a voltage supply unit to supply the bipolar voltage between the gate terminal 22 and the emitter terminal 12.

In addition, the bipolar-voltage supplying unit is capable of varying the number and an area of the pulse, thereby, amount of heat from the heater 30 can be controlled by selecting the number and the area of the pulse with the emitter terminal 12 supplied with the positive potential as shown in FIG. 2. As regards the pulses which are used to only drive the heater 30 in FIG. 2, and which are named first pulse, second pulse and third pulse toward right from left in turn, the first through third pulses differ from one another in number and area within a predetermined time interval. The first pulse is wider in pulse-width (namely, duty) and is larger in area than the second pulse. The third pulse is higher in amplitude than the first and second pulse, though it is not clear about the area. The amount of the heat is equal to a total of heat given by these first through third pulses and heat during emission of electrons. As a result, amount of the heat can be controlled by selecting the combination of the pulses given to the emitter terminal 12 when the pulses have the positive polarity. Heating the emitters does not adversely effect the emission of electrons in this invention.

Although, the field emission cold cathode apparatus has the heater like in the conventional apparatus, the number of terminal can be decreased in comparison with the conventional apparatus having the heater. In addition, high efficiency of cleaning emitters can be accomplished as well as a reduction of absorption of gas into emitters. In this embodiment shown in FIG. 1, two connection ends 31, 32 of the heater 30 share the emitter terminal 12 and the gate terminal 22 with the emitter electrode 10 and the gate electrode 20, respectively. This structure enables a reduction of the two terminals of the heater. Additionally, the field emission cold cathode apparatus get high efficiency of cleaning emitters with the prevention and restriction of absorbing gas into emitters, because the heater can be driven while not only emitting electrons but also emitting no electrons, by supplied the emitter terminals 12 with bipolar potential.

This embodiment may be modified on the basis of the concept of this invention in the following manner. Specifically, the field emission cold cathode apparatus may employ a focus electrode to focus the electron beams extracted by the gate electrode. This embodiment is not restricted to the case where the heater 30 is located under the emitter electrode 10, because FIG. 1 solely shows a general idea of this embodiment. For example, the heater 30 may be put on the location where the heater 30 can heat the emitters 11. Various types of the heaters are available of, if each heater has a structure which is electrically independent of the emitter electrode in this embodiment. For example, the heater may be located within an element or put on a fixing structure, where the element is a generic name for all components formed on a single substrate, the emitter electrode, the gate electrode, a insulator layer located between the emitter and gate electrode, a focus electrode, and so on, while the fixing structure is a structure fixing the element thereon and comprising some terminal utilized in supplying potentials to electrodes included in the element. Thus, all of the heater having at least two edges take such effects based on the same theory. Further, all of heaters described in the second through the tenth embodiments may also have above structures.

Furthermore. specific description will be made about the concrete structure of this embodiment below with reference to FIG. 3.

Figure 3:
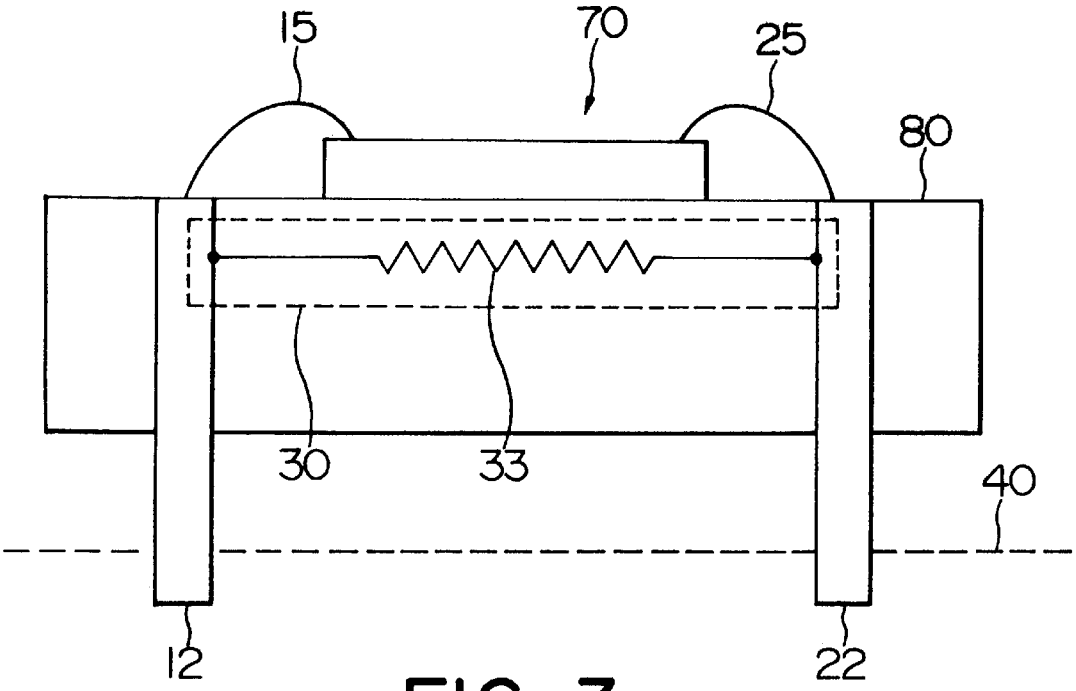
FIG. 3 is a view illustrating a concrete structure of the field emission cold cathode apparatus shown in FIG. 1.

In FIG. 3, the heater 30 is located at an outside of the element 70. As mentioned before, the element 70 has the emitter electrode 10, the gate electrode 20, the insulator located between the emitter and gate electrode, and so on. The fixing structure 80 has the emitter terminal 12 and the gate terminal 22. The fixing structure supports and fixes the elements thereon. The emitter electrode 10 and the gate electrode 20 are connected to the emitter terminal 12 and the gate terminal 22 by wires 15, 25, respectively.

It is to be noted that the resistor 33, which serves as the heater 30 is located between the emitter terminal 12 and the gate terminal 22 within the fixing structure 80.

The field emission cold cathode apparatus, having this concrete structure, takes the effects as mentioned above, by applying a predetermined voltage between the emitter terminal 12 and the gate terminal 22.

A field emission cold cathode apparatus according to the second embodiment of this invention is a modification of the first embodiment. Thus, description of this embodiment will be directed only to a difference between the first embodiment and the second one.

Figure 4:
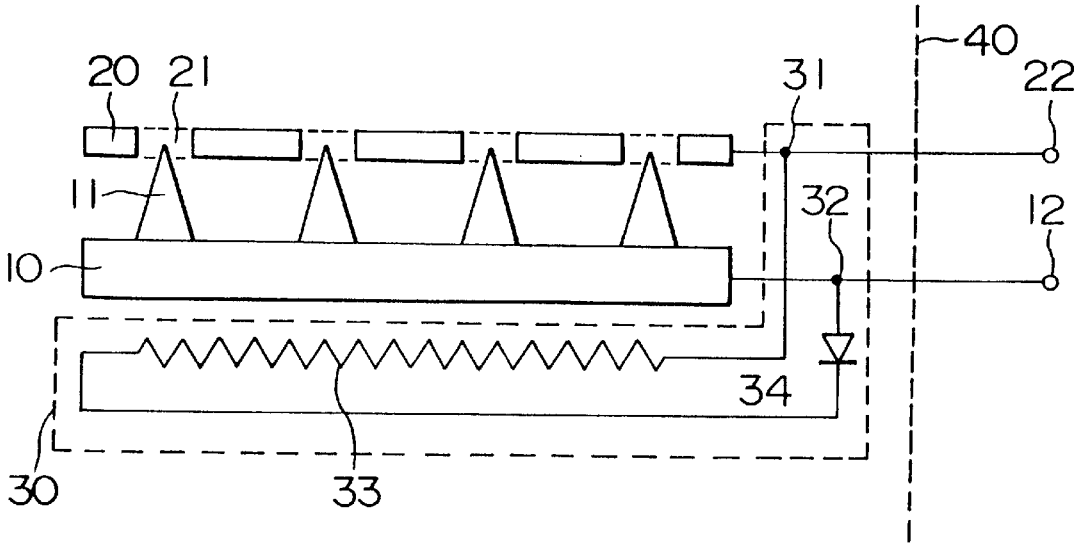
FIG. 4 is a view illustrating a field emission cold cathode apparatus according to the second embodiment of the present invention.

Briefly, the field emission cold cathode apparatus according to this embodiment can be specified by a heater 30*a* shown in FIG. 4. The heater 30*a* further comprises a diode 34 connected in series to the resistor 33. Both of the resistor 33 and the diode 34 are located between the two connection ends 31, 32. Specially, an anode of the diode 34 serves as the one connection edge 32, and is connected in common to the emitter terminal 12, in this embodiment. On the other hand, a cathode of the diode 34 is connected to the resistor 33.

Figure 5:
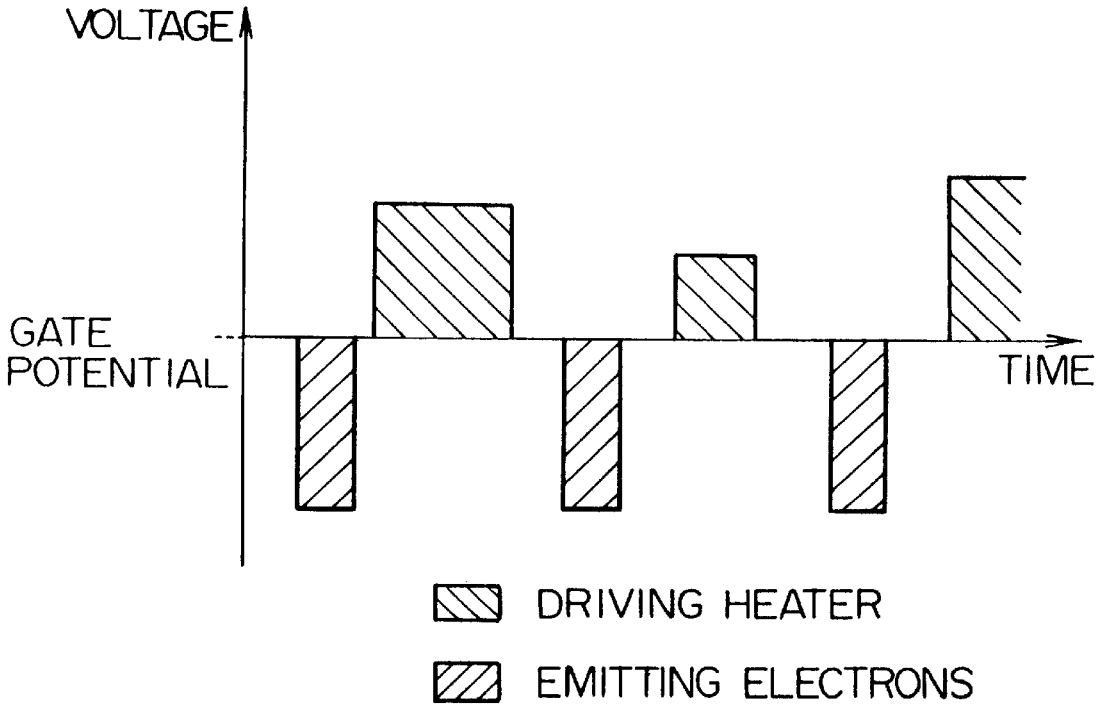
FIG. 5 is a graph view illustrating a variation of voltage value from the gate terminal to the emitter terminal shown in FIG. 4.

To drive the field emission cold cathode apparatus of this embodiment, bipolar-voltage is applied between the emitter terminal 12 and the gate terminal 22. FIG. 5 shows a variation of the potential at the emitter terminal 12 relative to the reference potential at the gate terminal 22. Like in FIG. 2, a pulse, which is hatched by lines slanted downwards on the right-hand side, causes the heater 30*a* to radiate heat, by a current passing through the resistor 33 and the diode 34, in FIG. 5. While another pulse, which is hatched by lines slanted upwards on the right-hand side, causes the electrons to be emitted from the emitter 11, by supplying the emitter electrode 10 with the negative potential, in FIG. 5. Thus, electrons are emitted with the emitter terminal 12 supplied with negative potential, while the heater 30 is driven with the emitter terminal 12 supplied with positive potential.

As understood above, this apparatus is driven by a bipolar-voltage supplying unit (not shown) as a voltage supply unit to supply the bipolar-voltage between the gate terminal and the emitter terminal. The bipolar-voltage supplying unit has the same structure as that of the first embodiment.

Although the field emission cold cathode apparatus has the heater like in the conventional apparatus, the number of terminal can be decreased in comparison with the conventional apparatus having the heater. Because two connection ends 31, 32 of the heater 30*a* share the emitter terminal 12 and the gate terminal 22 with the emitter electrode 10 and the gate electrode 20, respectively, in this embodiment as shown in FIG. 4. Additionally, the field emission cold cathode apparatus get high efficiency of cleaning emitters with the prevention and restriction of absorbing gas into emitters and the heater 30*a* can be controlled independently of electron emission, because the heater can be driven in a while without emission of electrons, by supplying the emitter terminals 12 with a positive potential.

It is considered that the apparatus of this embodiment has a capacitance between the sate electrode 20 and the emitter electrode 10, and the bipolar-voltage supplying unit has a impedance. It has been formed out that the field emission cold cathode apparatus illustrated in FIG. 4 stably acts in a high frequency region in comparison with the apparatus of the first embodiment, because the apparatus of this embodiment has the diode 34 between the gate electrode 20 and the emitter electrode 10.

This embodiment may be also modified in a manner to be described later, specifically, a focus electrode may be arranged like in the first embodiment. In addition the heater 30*a* may not always be located under the emitter electrode 10, because FIG. 4 shows a general idea of this embodiment. For example, the heater may be located within the element or put on the fixing structure like in the first embodiment. The diode 34 may be implemented by a semiconductor element formed in a semiconductor substrate, or be a diode unit connected to the outside in the receptacle.

Furthermore, specific description will be made about the concrete structure of this embodiment below.

In a simple example of this embodiment, which may be a modification of the concrete structure of the first embodiment, the modification comprises the diode connected in series to the resistor 33.

Moreover, the heater is classified into two types of heaters. One of the heaters has a resistor 33 which has a resistor end connected to the cathode of the diode 34 and another resistor end connected to the gate terminal 22. As shown in FIG. 4, the anode of the diode 34 is connected to the emitter terminal 12. Alternatively, the cathode of the diode 34 may be connected to the gate terminal 22, while the anode of the diode 34 is connected to one of two resistor ends given by the resistor 33, and another resistor end is connected to the emitter terminal 12. The latter will be described hereinafter with reference to FIG. 6.

Figure 6:
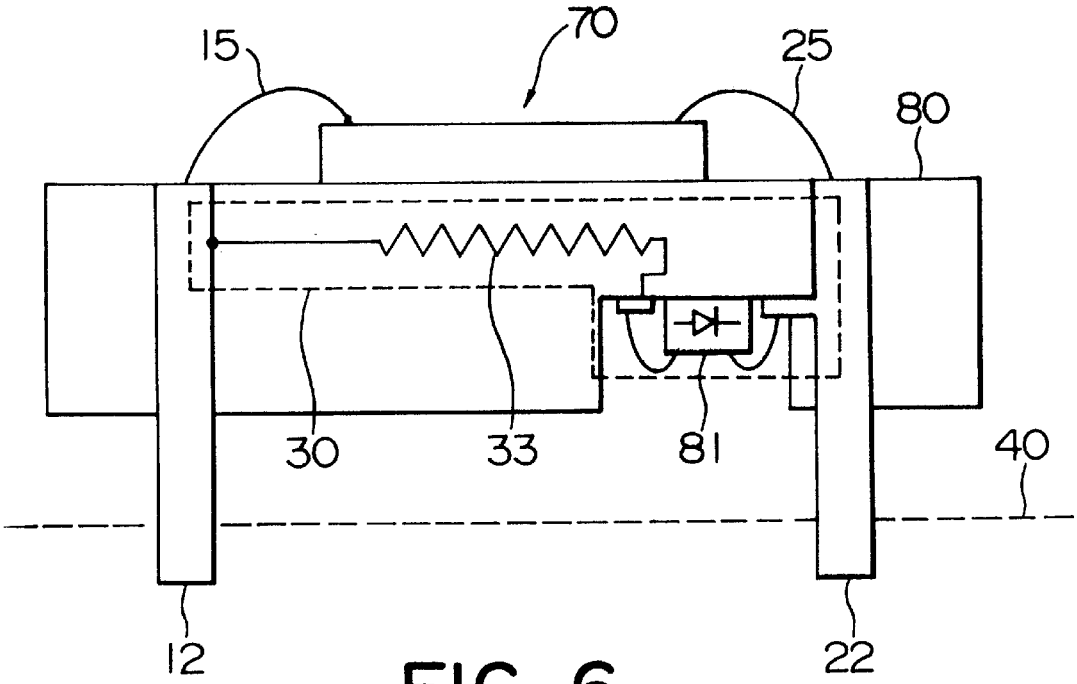
FIG. 6 is a view illustrating a concrete structure of the field emission cold cathode apparatus shown in FIG. 4.

The apparatus illustrated in FIG. 6 is similar in structure to that illustrated in FIG. 3 except that a diode chip 81 is included in the apparatus shown in FIG. 6. Specifically, the fixing structure 80 has an insulator body. The element 70 is put on an upper surface of the insulator body which the insulator body has a recessed part formed on a back surface of the insulator body. In the illustrated fixing structure 80, the diode chip 81 is placed within the recessed part. A cathode of a diode included in the diode chip 81 is connected to the gate terminal 22 while an anode of the diode is connected to one of two resistor ends of the resistor 33.

The recessed part may be formed at a different position as well as the element 70. Further, the fixing structure 80 may not be always positioned within the recessed part.

Figure 7:
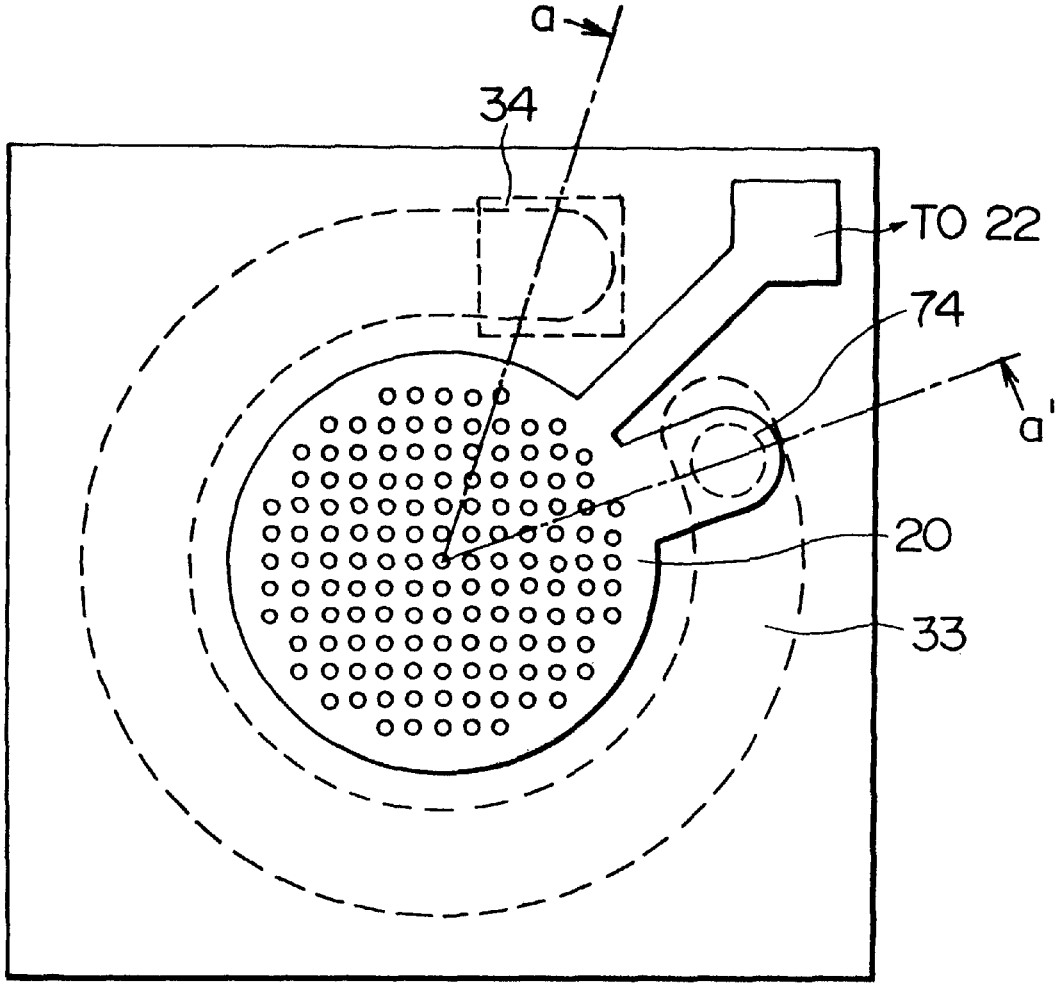
FIG. 7 is a plan view illustrating another concrete structure of the field emission cold cathode apparatus shown in FIG. 4.
Figure 8:
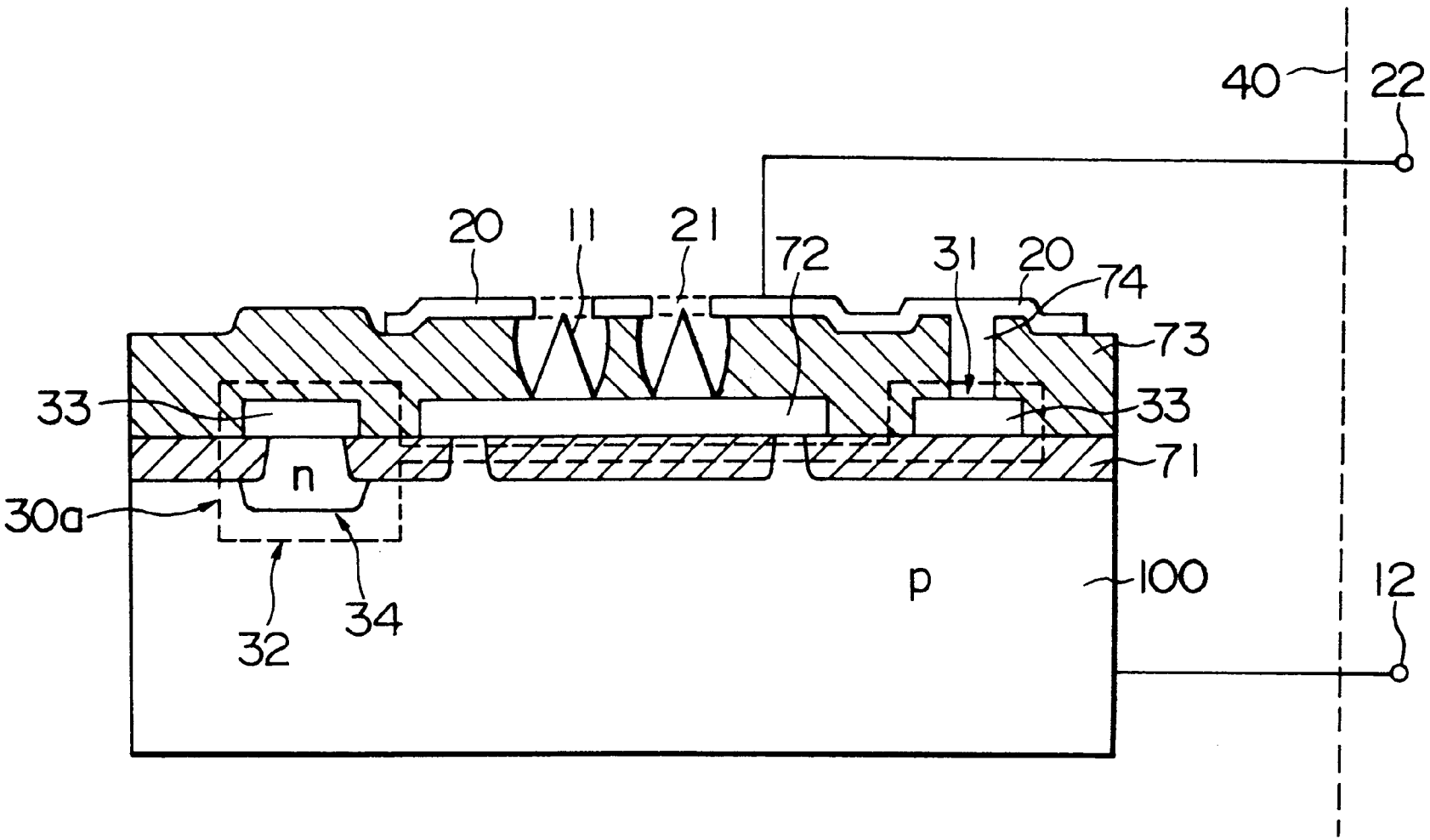
FIG. 8 is a cross-sectional view taken along the line a–a• of FIG. 7.

Referring to FIGS. 7 and 8, description will be made about the another concrete structure of the second embodiment mentioned in conjunction with FIG. 4.

In FIGS. 7 and 8, tho heater, 30*a* is assembled together with the emitters 11, the gate electrode 20, and the like.

As shown in FIG. 8. the field emission cold cathode apparatus has a silicon substrate 100 and insulator layers 71 each of which is formed on a predetermined part of the silicon substrate 100. The illustrated silicon substrate 100 is formed by a p-type semiconductor. In addition, the silicon substrate 100 comprises an n-type region interposed between the insulator layers 71. A part of the silicon substrate 100 and the n-type region serve as the diode 34.

This field emission cold cathode apparatus further has a resistor layer 72 and the plurality of the emitters 11 on the resistor layer 72, which restricts a current flowing into the emitters 11. The resistor layer 72 is formed on the insulator layers 71 and the silicon substrate 100, and is supplied with a voltage through the silicon substrate 100 located between the insulator layers 71. The silicon substrate 100, the resistor layer 72, and the plurality of the emitters 11 constitute the emitter electrode 10 mentioned above.

The illustrated heater 30*a* comprises the diode 34 and the resistor 33. The diode 34 is composed of the n-type region and the part of the p-type silicon substrate 100 as mentioned above. The resistor 33 has two resistor ends and surrounds an emitter area. One of the resistor ends is located on and connected to the n-type region while the remaining one of the resistor ends is connected to the gate electrode 20 which is supported by an insulator layer 73 and which is connected to a contact 74 formed in the insulator layer 73.

In this structure, when the emitter terminal 12 is supplied with the positive potential, the diode 34 is put into an on-state, and then a current flows to the gate electrode 20 through the resistor 33 and the contact 74. As a result, the resistor 33 is heated by the current.

The following will be directed to a method of manufacturing the apparatus illustrated in FIG. 8.

Figure 9A:
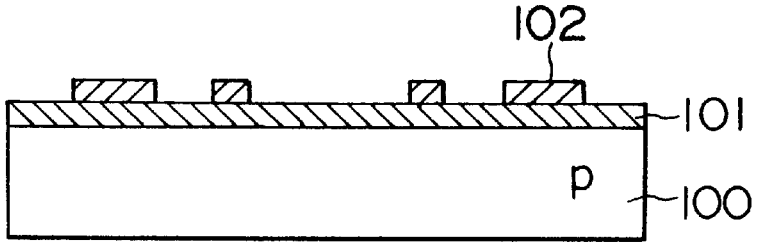
FIGS. 9A through 9G, inclusive are cross-sectional views for successive steps in the method of producing the structure of FIGS. 7 and 8.

Referring to FIGS. 9A through 9G, a $Si_3N_4$ film 101 and a photo-resist layer is successively deposited on the p-type silicon substrate 100. The photo-resist layer is patterned into a predetermined photo-resist pattern 102 by a photolithography technique, as shown in FIG. 9A. The $Si_3N_4$ film 101 is employed as a mask in a process of LOCOS (local oxidation of silicon) known in the art. Further, a silicon dioxide film ($SiO_2$) may be formed as an intermediate film between this $Si_3N_4$ film 101 and the p-type silicon substrate 100.

Figure 9B:
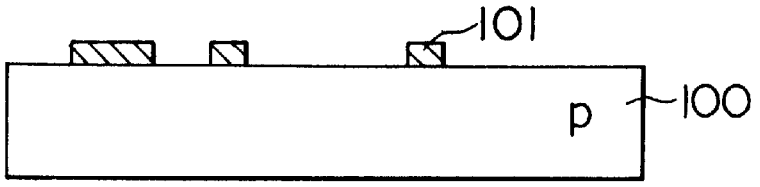

By using the predetermined photo-resist pattern 102 as a mask, the $Si_3N_4$ film 101 is etched, and then the pattern 102 is removed, as shown in FIG. 9B.

Figure 9C:
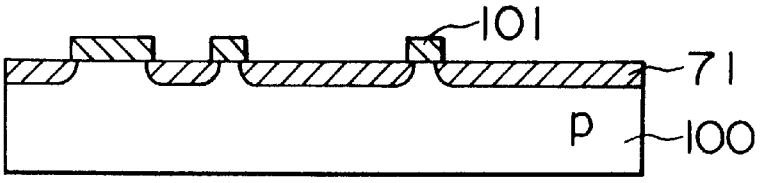

Thereafter, an insulator 71 is formed by using the LOCOS process and the $Si_3N_4$ film 101 as a mask, as shown in FIG. 9C. In the example, the insulator 71 is formed by $SiO_2$.

Figure 9D:
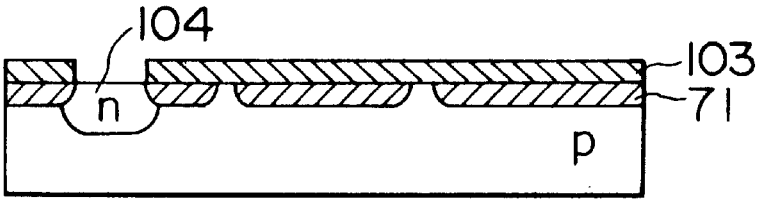

After the $Si_3N_4$ film 101 is removed, a photo-resist layer is formed on all over an exposed surface, and patterned into a photo-resist pattern 103 by selectively removing the photo-resist layer. As a result, the silicon substrate 100 of the p-type is partially exposed. Under the circumstances, phosphorus ions are implanted into the exposed portion of the silicon substrate 100 by utilizing the photo-resist pattern 103 as a mask. Thus, the n-type region 104 is formed in the silicon substrate, as shown in FIG. 9D.

Figure 9E:
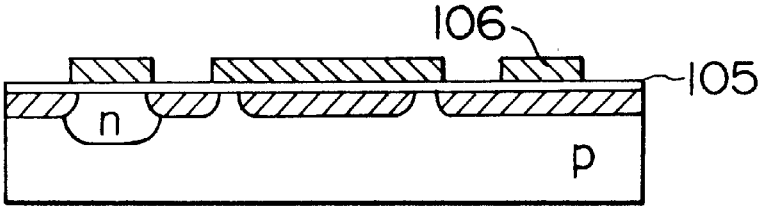

After removal of the photo-resist pattern 103, a polysilicon film is deposited as a resistor layer 105 by CVD (chemical vapor deposition), as shown in FIG. 9E. Subsequently, a photo-resist layer is formed on a whole of the resistive layer 105 and then patterned into a photo-resist pattern 106 by the use of the usual photolithography technique.

Figure 9F:
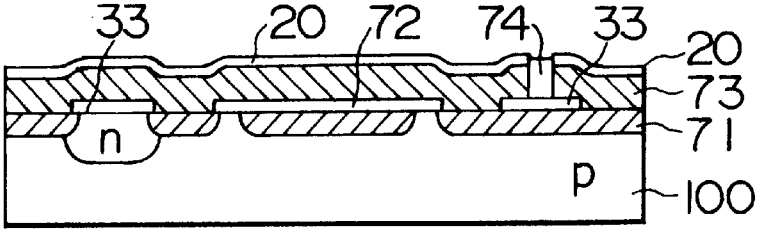

By making use of the photo-resist pattern 106 as a mask, the resistor layer 105 is etched and. thereby, is divided into a resistor 33 and a resistor layer 72, as shown in FIG. 9F. Thereafter, the insulator layer 73 and the gate electrode 20 are deposited on all over an exposed surface, by means of a deposition process, such as a PVD (physical vapor deposition) process or a CVD (chemical vapor deposition) process. Next, the insulator layer 73 and the gate electrode 20 are selectively etched to form a via hole which reaches the resistor 33. Then, a contact 74 is formed into the via hole by plugging up or filling with a material into the via hole, as shown in FIG. 9F.

This process may be modified as follows. After deposition of the insulator layer 73, a via hole is formed into the insulator layer 73 before deposition of the gate electrode 20. The contact 74 may be plugged up into the via hole, and thereafter, the gate electrode 20 may be deposited on the resistor 73.

Figure 9G:
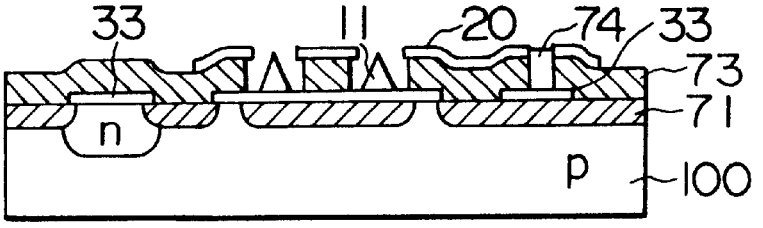

Subsequently, the gate electrode 20 and the insulator layer 73 are selectively etched by the gate electrode 20 and the insulator layer 73 to form holes. Although not shown in FIG. 9G, a release layer (or a sacrificed layer) is deposited above the gate electrode 20 to form emitters 11. In the known manner, the emitters 11 are formed with in the holes and have cone shapes. By removing the release layer, the apparatus according to this invention is manufactured, as shown in FIG. 9G.

A field emission cold cathode apparatus according to the third embodiment of this invention is a modification of the first embodiment. Therefore, description of this embodiment will be restricted to a difference between the first and the third embodiments.

Figure 10:
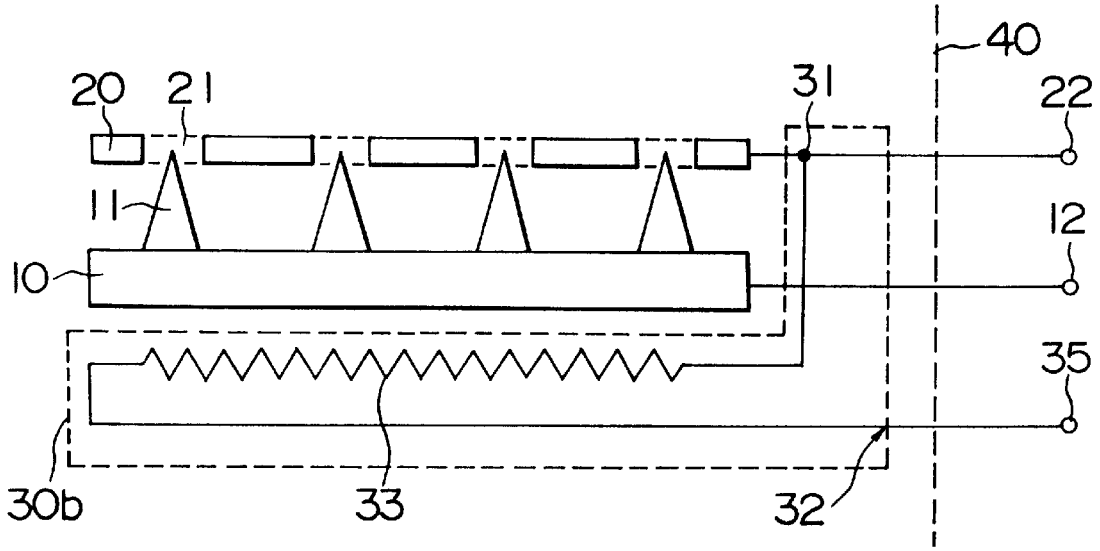
FIG. 10 is a view illustrating a field emission cold cathode apparatus according to the third embodiment of the present invention.

Referring to FIG. 10, the field emission cold cathode apparatus according to the third embodiment is different from the first embodiment in that a heater terminal 35 is electrically connected to a heater 30*b* is extended outside of the apparatus, as shown in FIG. 10. Specifically, the heater 30*b* has two connection ends 31, 32, one of which is connected to the heater terminal 35 as denoted by 32. The remaining connection end 31 is connected in common to the gate electrode 20.

As understood above, the field emission cold cathode apparatus illustrated in FIG. 10 is also advantageous in that the number of the terminal can be decreased by one as compared with the conventional apparatus which has the heaters.

With this structure, a voltage is given to emit electrons while another voltage is impressed to the heater 30*b*. This shows that two voltage supplying units are needed in this apparatus and differ from each other. More particularly, one of the voltage supplying units applies the voltage between the emitter terminal 12 and the gate terminal 22 to emit the electrons from the emitters. While another one of the voltage supplying units applies another voltage between the heater terminal 35 and the gate terminal 22. The voltage applied between the heater terminal 35 and the gate terminal 22 should be high enough to heat the heater 30*b*. Therefore, both of the two voltage supplying units may be restricted to neither the unit generating pulses nor the bipolar-voltage supplying unit, as described in the first embodiment. Thus, the voltage can be varied in various manners in the illustrated apparatus as compared with the first embodiment. For example, one of voltage supplying units may be restricted to that mentioned in the first embodiment while the other one may be changed by uses of the field emission cold cathode apparatus. Examples of the unit relating to electron emission are as follows. The unit may be a constant voltage unit, if the apparatus is utilized in a TWT for communication. Alternatively, the unit may be a pulse source unit, if the apparatus is utilized in a TWT for radar. Further, the unit may be a voltage source unit for generating a voltage modulated by a luminous signal, if the apparatus is utilized in a display device such as CRT (Cathode Ray Tube) and so on.

Figure 11:
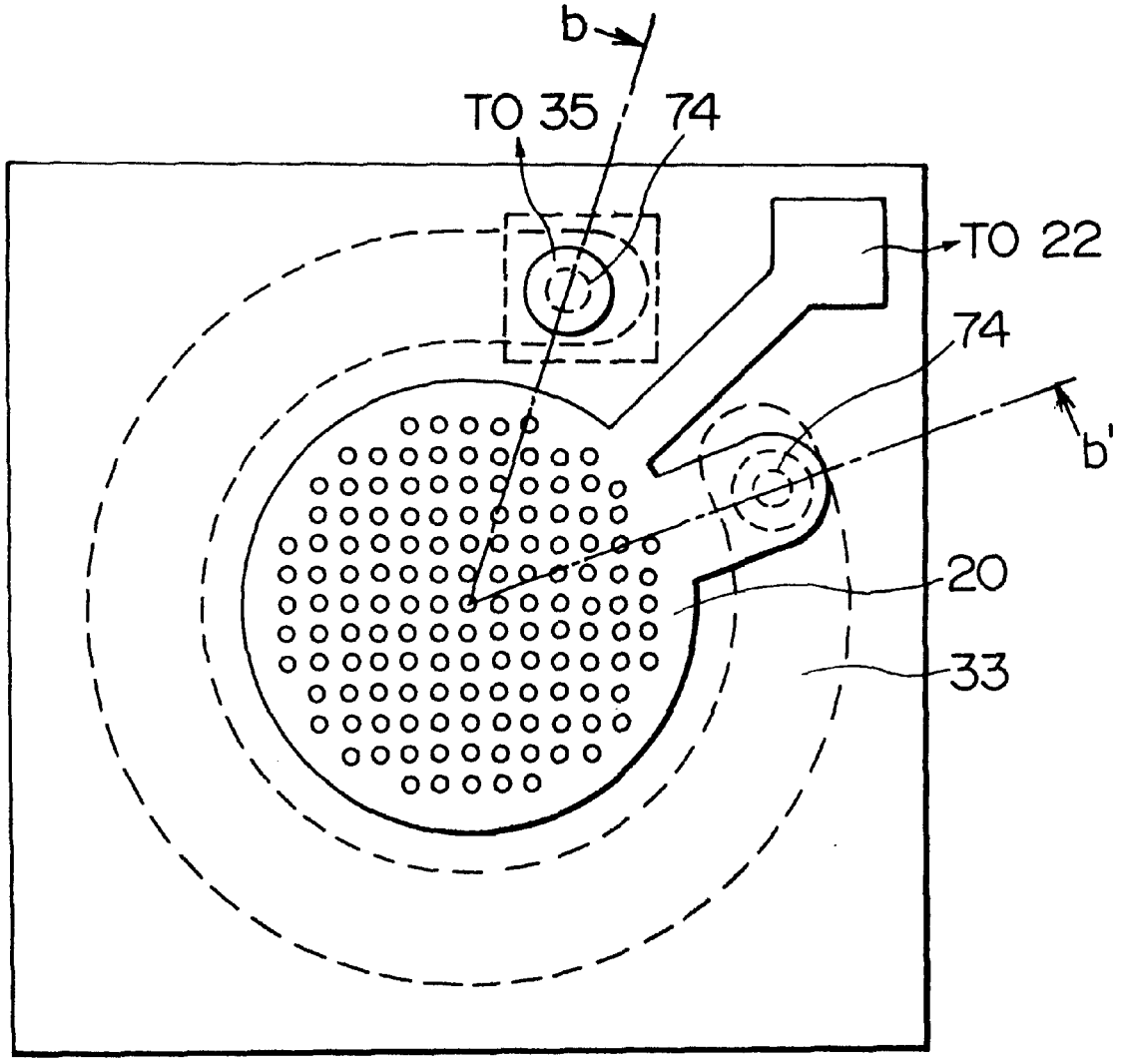
FIG. 11 is a plan view illustrating a concrete structure of the field emission cold cathode apparatus shown in FIG. 10.
Figure 12:
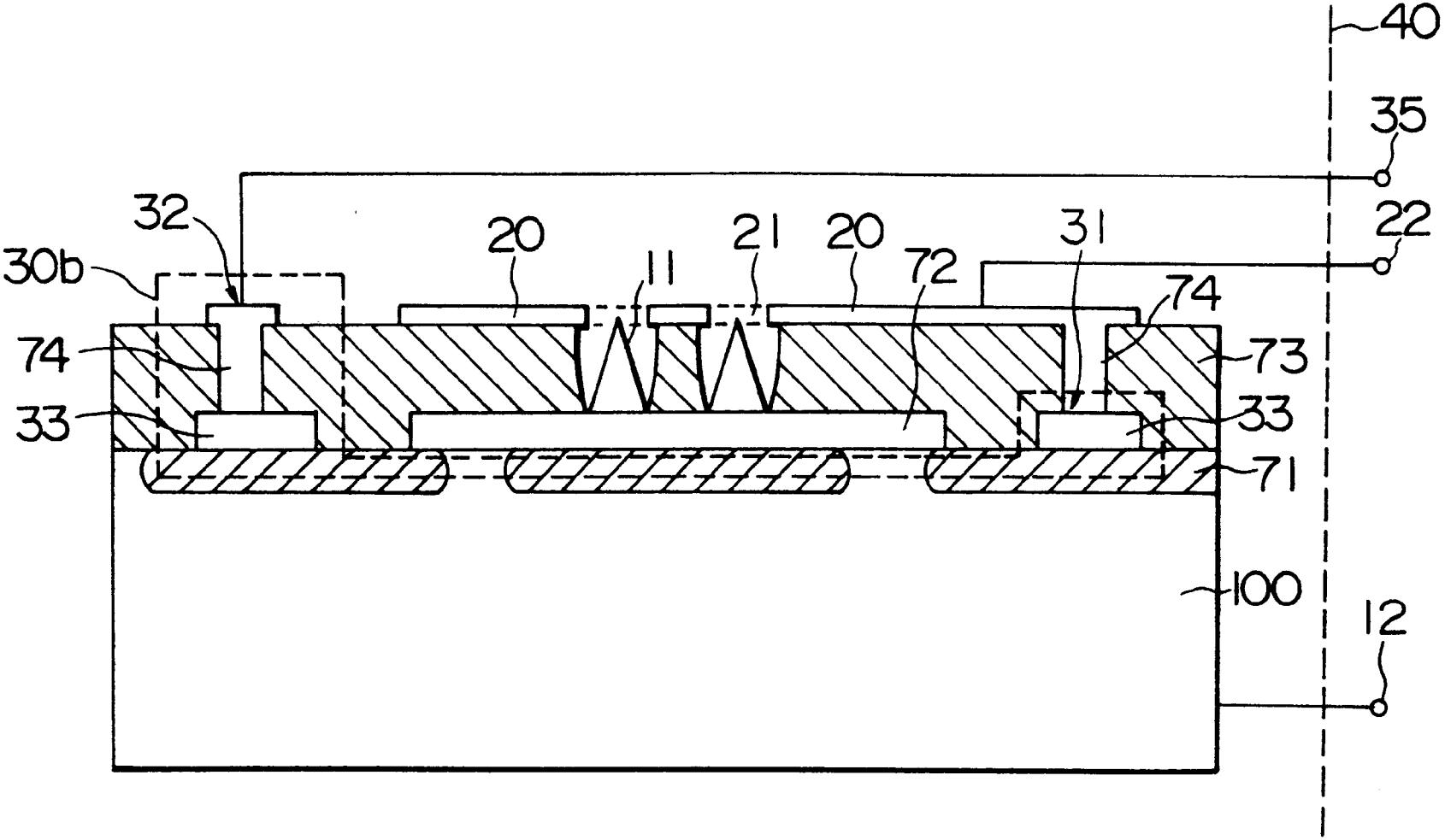
FIG. 12 is a cross-sectional view taken along the line b–b• of FIG. 11.

Referring to FIGS. 11 and 12, the apparatus according to the third embodiment will be described in detail below.

In FIGS. 11 and 12, it is noted that the heater 30*b* (FIG. 12) is located within the inside of an element which includes the emitters 11, the gate electrode 20, and the like.

The illustrated field emission cold cathode apparatus has a silicon substrate 100 and insulator layers 71, each of which is formed on a predetermined part of the silicon substrate 100.

As shown in FIG. 12, a resistor layer 72 underlies the plurality of the emitters 11 to restrict a current flowing into the emitters 11, like in the second embodiment. The resistor layer 72 is formed not only on the insulator layers 71 and but also on the silicon substrate 100. In this structure, a voltage is impressed to the resistor layer 72 through the silicon substrate 100 which is electrically connected to the resistor layer 72. From this fact, it may be said that a part of the silicon substrate 100, the resistor layer 72, and the plurality of the emitters 11 are operable as the emitter electrode 10.

In the heater 30*b*, the resistor 33 surrounds an outer periphery of the resistive layer 72 and is placed on the insulator layer 71. The resistor 33 has two resistor ends one which is connected to the gate electrode 20 supported on an insulator 73, and the other one of which is connected to the heater terminal 35 through contacts 74 formed through the insulator 73.

In this structure, a predetermined voltage is given between the heater terminal 35 and the gate terminal 22. As a result, the current flows into the resistor 33 which surrounds the emitter area (the resistor layer 72 and the emitters 11). and which is heated.

Figure 13:
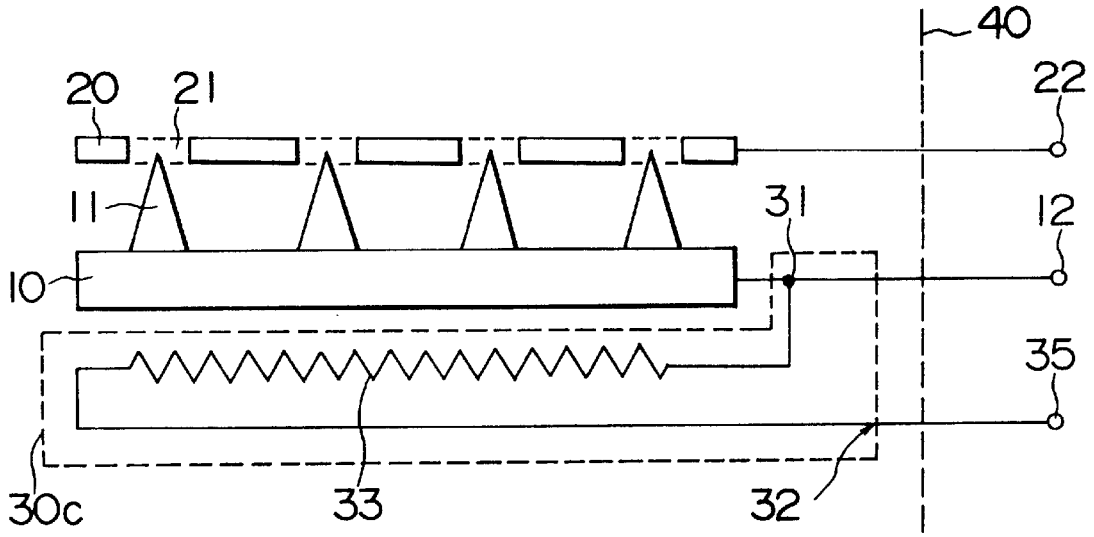
FIG. 13 is a view illustrating a field emission cold cathode apparatus according to the fourth embodiment of the present invention.

Referring to FIG. 13, a field emission cold cathode apparatus according to the fourth embodiment of this invention is similar in structure to that illustrated in FIGS. 11 and 12 except that a heater 30*c* has a connection end 31 connected in common to the emitter terminal 12. Like in FIG. 10, the heater terminal 35 of the heater 30*c* is extended to the outside of the receptacle which envelopes this apparatus With this structure, the field emission cold cathode apparatus illustrated in FIG. 13 can decrease the number of the terminal as compared with the conventional techniques, like in FIG. 10.

Further, this apparatus needs two voltage supplying units, like in the mentioned third embodiment. More particularly, one of the voltage supplying units applies the voltage between the heater terminal 35 and the emitter terminal 12 should be high enough to heat the heater 30*c* heat.

Figure 14:
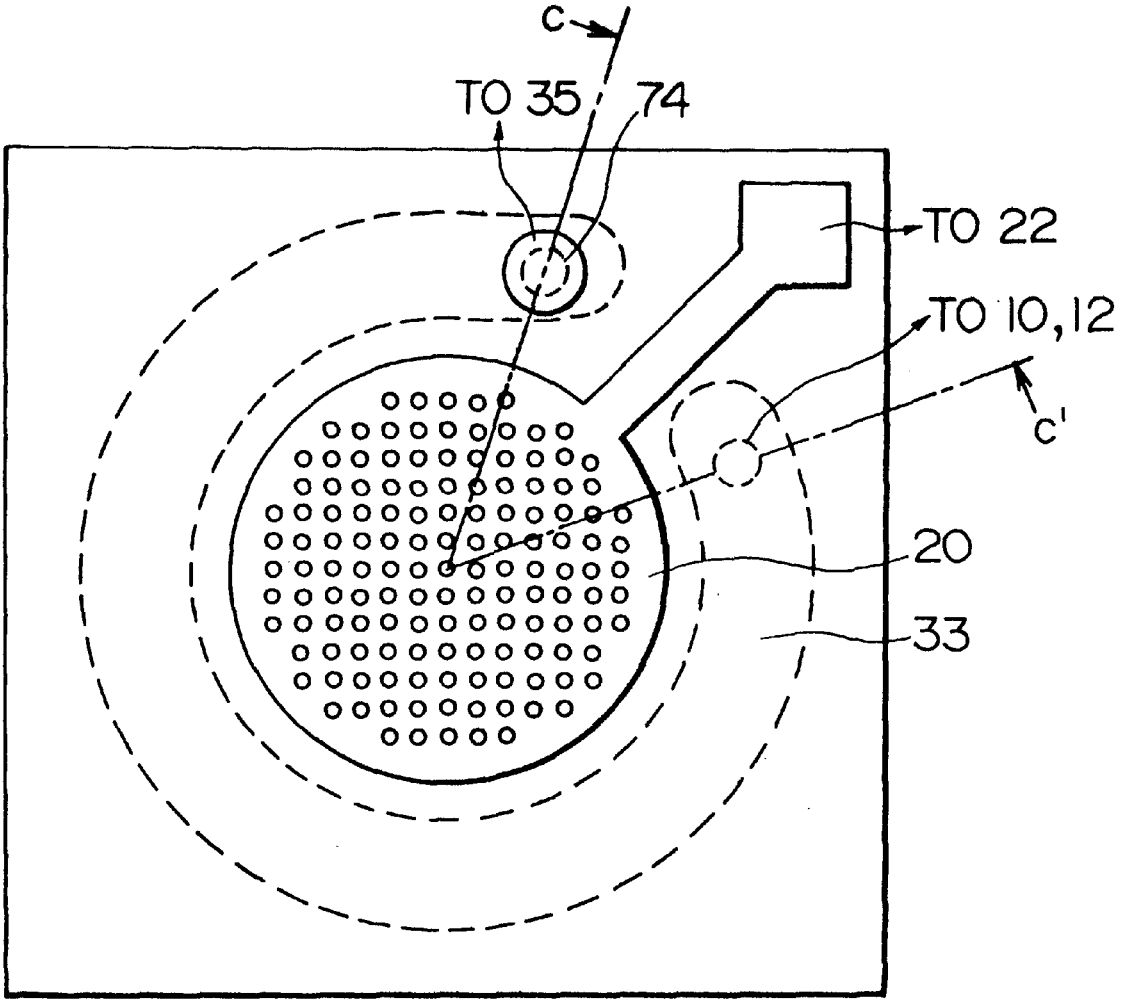
FIG. 14 is a plan view illustrating a concrete structure of the field emission cold cathode apparatus shown in FIG. 13.
Figure 15:
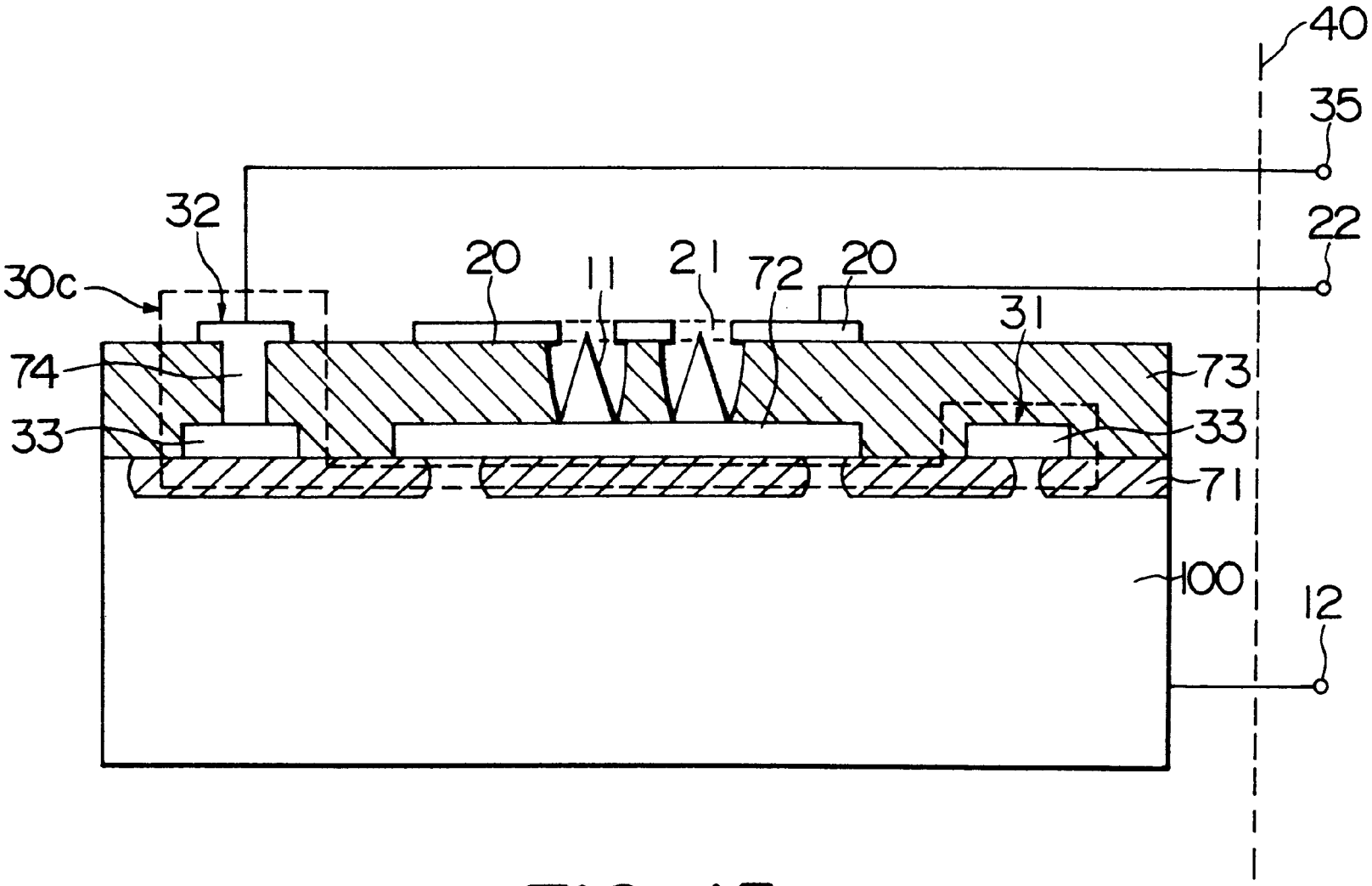
FIG. 15 is a cross-sectional view taken along the line c–c• of FIG. 14.

Referring to FIGS. 14 and 15, the heater 30*c* is arranged within inside of an element which includes the emitters 11, the gate electrode 20.

In FIG. 15, the field emission cold cathode apparatus has a silicon substrate 100 and insulator layers 71 each of which is formed in predetermined parts of the silicon substrate 100.

This field emission cold cathode apparatus further has a resistor layer 72 and the plurality of the emitters 11 on the resistor layer 72. The resistor layer 72 serves to restrict a current flowing into the emitters 11, like in the third embodiment and is laid not only the insulator layers 71 but also on a part of the silicon substrate 100. The resistor layer 72 is supplied with a voltage through the part of the silicon substrate 100 connected to the resistor layer 72. Taking the above units consideration, it may be said that a combination of the silicon substrate 100, the resistive layer 72, and the plurality of the emitters 11 is operable as the emitter electrode 10.

The heater 30*c* is composed of the resistor 33 which is arranged around the outer periphery of the resistor layer 72, and which is placed on the insulator layer 71. The resistor 33 has two resistor ends. In the illustrated example, one of the resistor ends is connected to the emitter terminal 12 which is derived from the silicon substrate 100 and which is electrically connected to the resistor 33. While the remaining one of the resistor ends is connected to the heater terminal 35 through contacts 74 formed through the insulator layer 73.

In this structure, when a predetermined voltage is supplied between the heater terminal 35 and the emitter terminal 12. The current flows into the resistor 33 placed around an emitter area (the resistive layer 72, the emitters 11), to heat the resistor 33.

Figure 16:
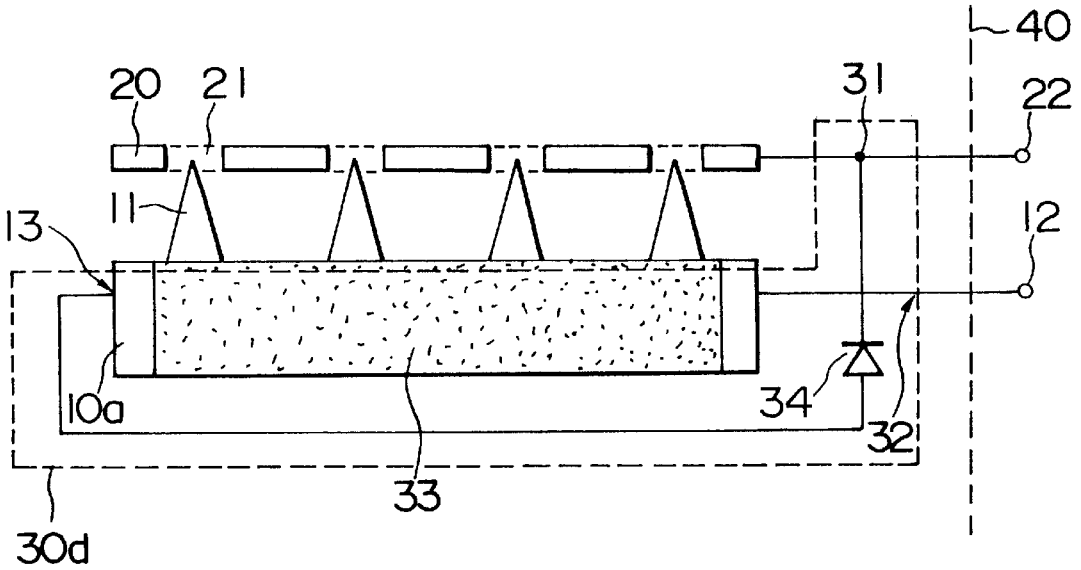
FIG. 16 is a view illustrating a field emission cold cathode apparatus according to the fifth embodiment of the present invention.

Referring to FIG. 16, a field emission cold cathode apparatus according to the fifth embodiment of this invention is similar in structure to that illustrated in conjunction with the second embodiment except that a part of an emitter electrode 10*a* is formed by a resistor material and serves as the resistor 33, and that a heater 30*d* includes the part of emitter electrode 10*a*, as shown in FIG. 16. The heater 30*d* further comprises a diode 34 connected in series to the resistor 33. Both of the resistor 33 and the diode 34 are located between the two connection ends 31, 32. Specially, a cathode of the diode 34 serves as the one connection ends 31 and is connected in common to the gate terminal 22, in this embodiment. On the other hand, an anode of the diode 34 is connected to one side 13 of the emitter electrode 10*a*. The heater ends 32 is located within a connection path extended from another side of the emitter electrode 10*a* to the emitter terminal 12. Needless to say, the resistor 33 has a structure which generates heat when the positive potential relative to the gate terminal 22 is supplied to the emitter terminal 12.

As understood above, the field emission cold cathode apparatus has the same advantage as the second embodiment, and further has an effect as mentioned below. It is well-known that the emitter electrode 10*a* itself is partially formed by a resistor material. In this embodiment, the resistor material serves as a part of the heater by connecting the other side to the gate terminal 22 through the diode 34. As a result, this embodiment can simply avoid an increase of fabrication. And this embodiment can be fabricated by the use of a well-known technique.

Figure 17:
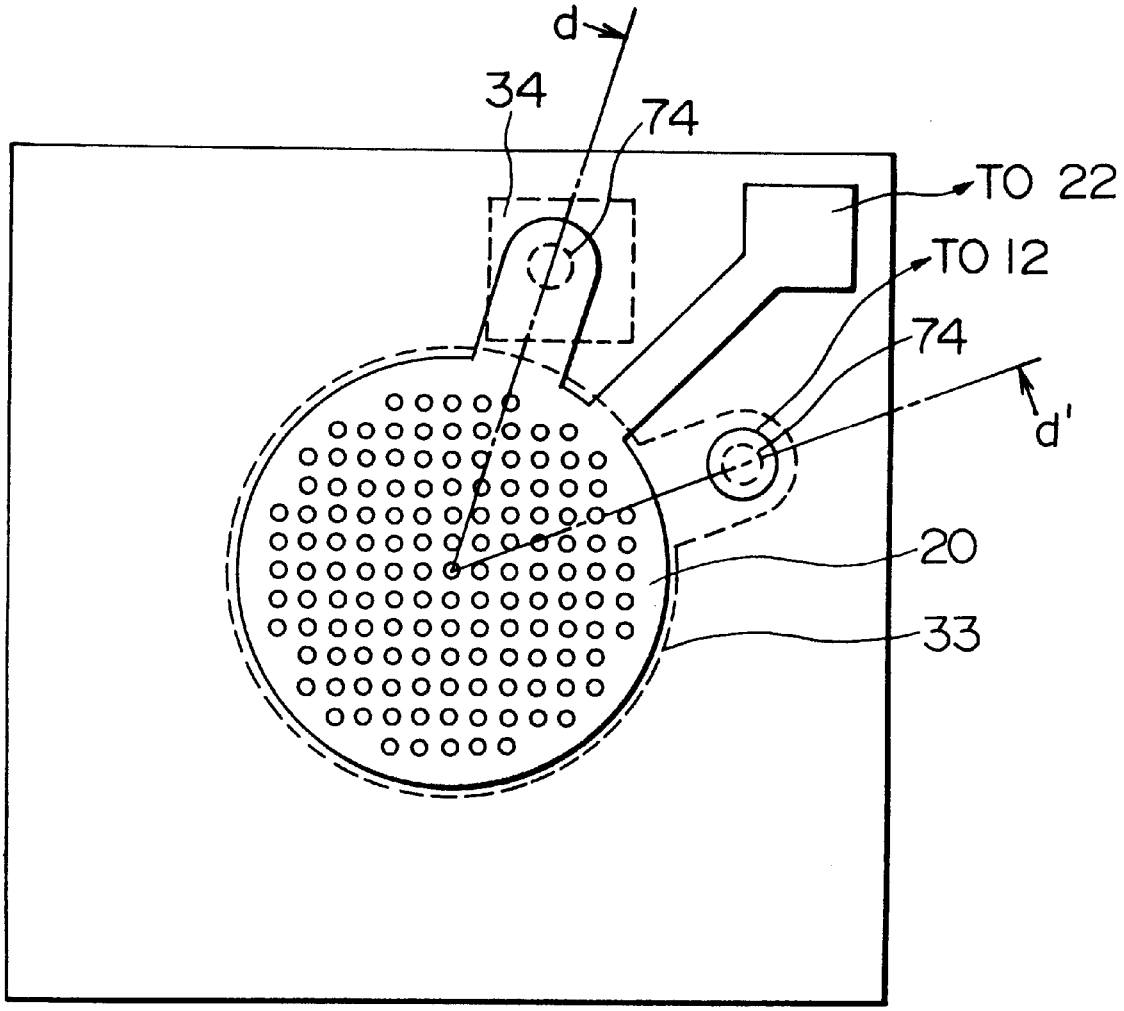
FIG. 17 is a plan view illustrating a concrete structure of the field emission cold cathode apparatus shown in FIG. 16.
Figure 18:
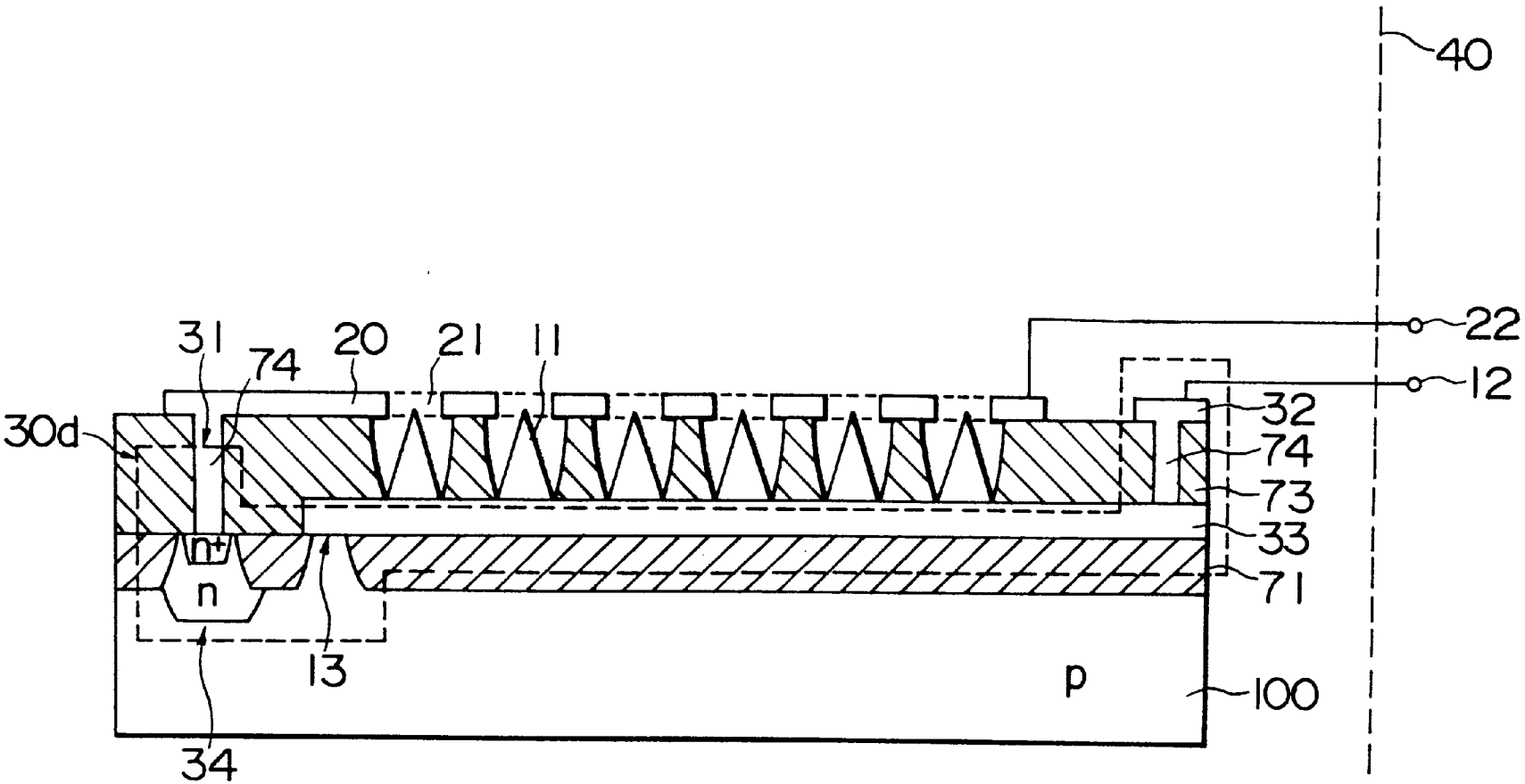
FIG. 18 is a cross-sectional view taken along the line d–d• of FIG. 17.

In FIGS. 17 and 18, the heater 30*d* is arranged within an element which includes the emitters 11, the gate electrode 20.

This field emission cold cathode apparatus has a silicon substrate 100 and insulator layers 71 each of which is formed on a predetermined part of the silicon substrate 100. In the illustrated example, the silicon substrate 100 is made from a p-type semiconductor. An n-type region is interposed in the silicon substrate 100 between two adjacent ones of the insulator layers 71. A part of the silicon substrate 100 and the n-type region serve as the diode 34. Further, an $n^+$-type region in FIG. 18 is formed to provide the ohmic contact with the n-type region and a contact 74, as mentioned below.

This field emission cold cathode apparatus further has a resistor layer 72 and the plurality of the emitters 11 on an area corresponding to the emitter area of the resistor layer 72. The resistor layer 72 restricts a current flowing into the emitters 11 and is overlaid on the insulator layers 71 and one part of the silicon substrate 100. With this structure, a voltage is given to the resistor layer 72 through a part of the silicon substrate 100 which is electrically connected to the resistor layer 72. The silicon substrate 100, the resistive layer 72, and the plurality of the emitters 11 may be collectively called the emitter electrode 10.

The heater 30*d* comprises the diode 34 and the resistor 33 which is formed by a part of the resistor layer 72. The diode 34 consists of the n-type region and a part of the p-type silicon substrate 100 as mentioned above. The resistor 33 has two resistor ends and defines an emitter area. One of the resistor ends is located on the silicon substrate 100 and electrically connected to the diode 34, while the remaining one of the resistive edges is connected to the emitter terminal 12 through a contact 74 formed through the insulator layer 73. The $n^+$-type region of the diode 34 is connected to the gate electrode 20 through another contact 74 formed through the insulator layer 73.

In this structure, when the positive potential is given to the emitter terminal 12, the diode is put into an on-state. Thus, a current flows to the gate electrode 20 through the resistor 33 and the contact 74, to heat the resistor 33.

Figure 19:
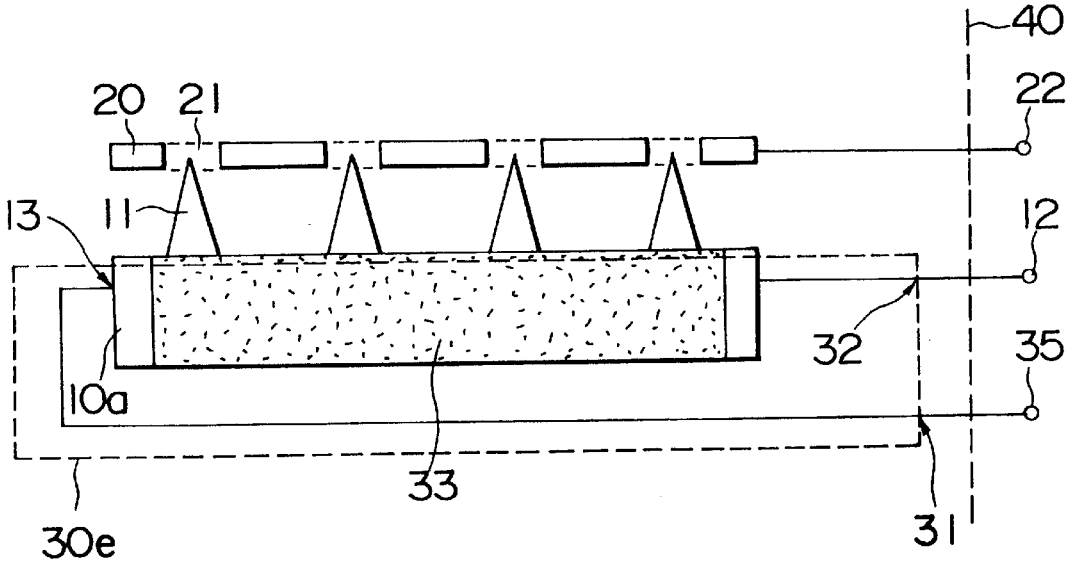
FIG. 19 is a view illustrating a field emission cold cathode apparatus according to the sixth embodiment of the present invention.

A field emission cold cathode apparatus according to the sixth embodiment of this invention is similar in structure to that illustrated in conjunction with the fifth embodiment except that no diode 34 is included in the heater 30*e*, as shown in FIG. 19.

Like in the fifth embodiment, the field emission cold cathode apparatus according to the sixth embodiment is featured in that a part of emitter electrode 10*a* serves as a resistor 33, that a heater 30*e* includes a part of emitter electrode 10*a* therein, and that a heater terminal 35 is extended from one of two connection ends 31 of the heater 30*e* outside of the apparatus, as shown in FIG. 19. The resistor 33 which is formed by the part of the emitter electrode 10*a* is located between the two connection ends 31, 32 of the heater 30*e*. The heater end 31 is placed within a connection path between one side 13 of the emitter electrode 10*a* and the heater terminal 35. The other heater end 32 is placed within a connection path between another side of the emitter electrode 10*a* and the emitter terminal 12. This shows that the heater end 32 is connected to the emitter electrode 12. It is needless to say that the resistor 33 generates heat when a voltage is given between the emitter terminal 12 and the heater terminal 35.

When the field emission cold cathode apparatus of this embodiment is driven, consideration should be made about the following as facts. A gradient of a potential increases within the resistor 33 included in the heater 30*e*, when the heater 30*e* is driven and heats the emitter electrode. Such a gradient of a potential disturbs a emission characteristic of electrons. Therefore, it is desirable to provide the resistor 33 with a voltage to drive the heater at the beginning of or before emission of electrons. On the other hand, if such a strict requirement is imposed on the emission characteristic of electrons, the apparatus can be driven, as the above mentioned in the manner mentioned in conjunction with the fourth embodiment.

As understood above, the field emission cold cathode apparatus has the same advantage as the fourth embodiment, and further has an effect as mentioned below. It is a well-known that the emitter electrode 10*a* itself is partially formed by a resistor material. In this embodiment, the resistor material serves as a part of the heater by connecting the other side to the gate terminal 22 through the diode 34. As a result, this embodiment can simply avoid an increase of fabrication. And this embodiment can be fabricated by the use of a well-known technique.

Figure 20:
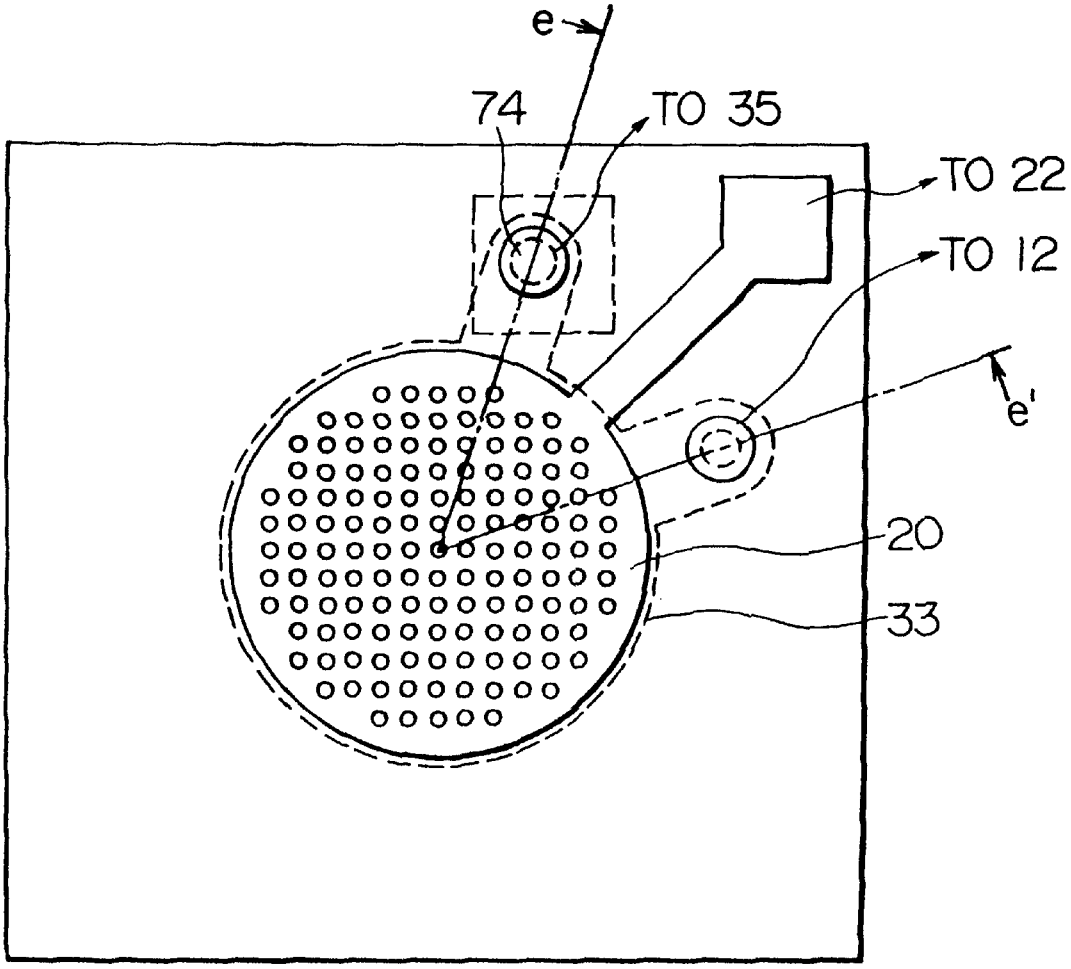
FIG. 20 is a plan view illustrating a concrete structure of the field emission cold cathode apparatus shown in FIG. 19.
Figure 21:
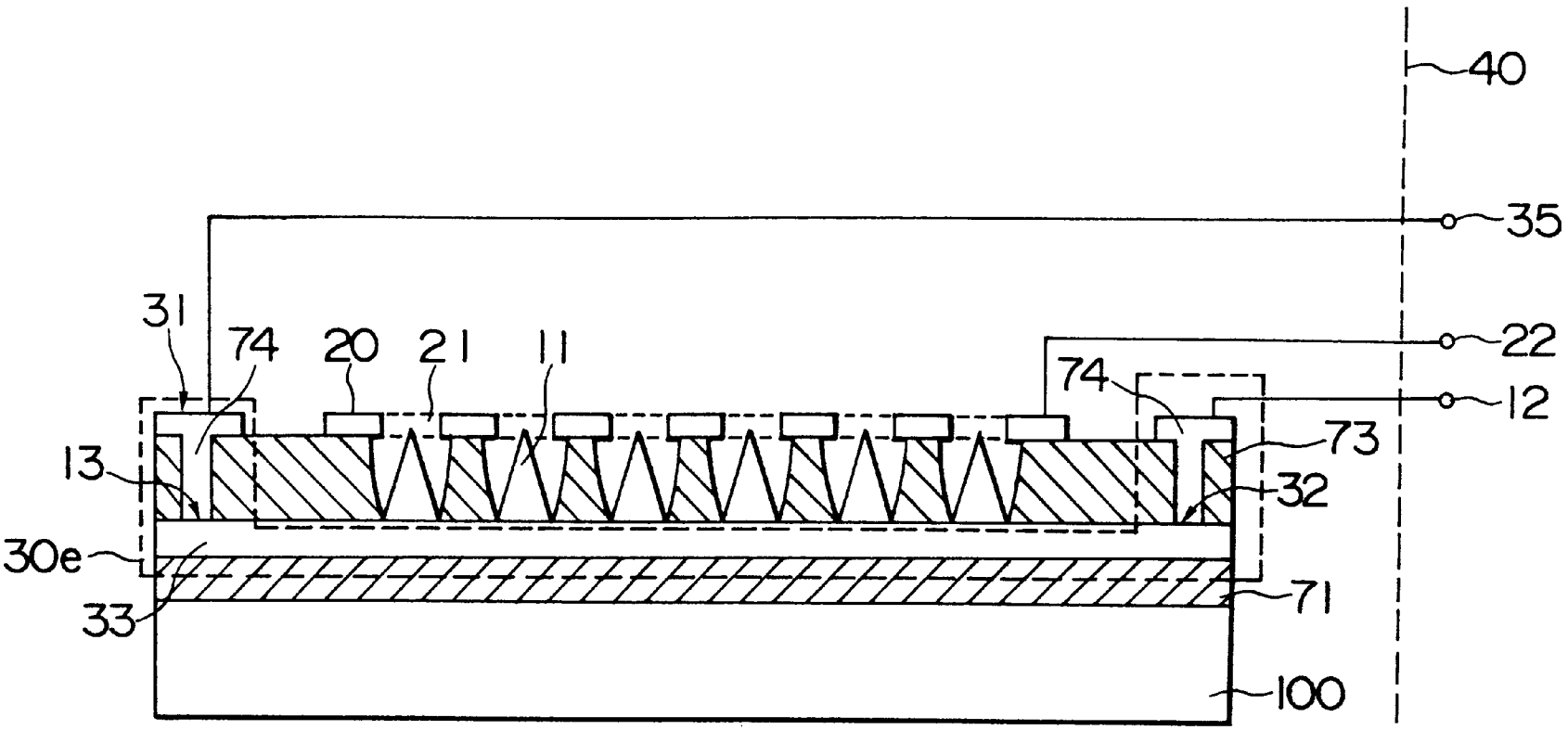
FIG. 21 is a c:ross-sectional view taken along the line e–e• of FIG. 20.

Referring to FIGS. 20 and 21, description will be made in detail about a structure of the sixth embodiment according to this invention.

In FIGS. 20 and 21, the heater 30*e* is formed by the use of a resistor layer, as will become clear later.

Figure 22:
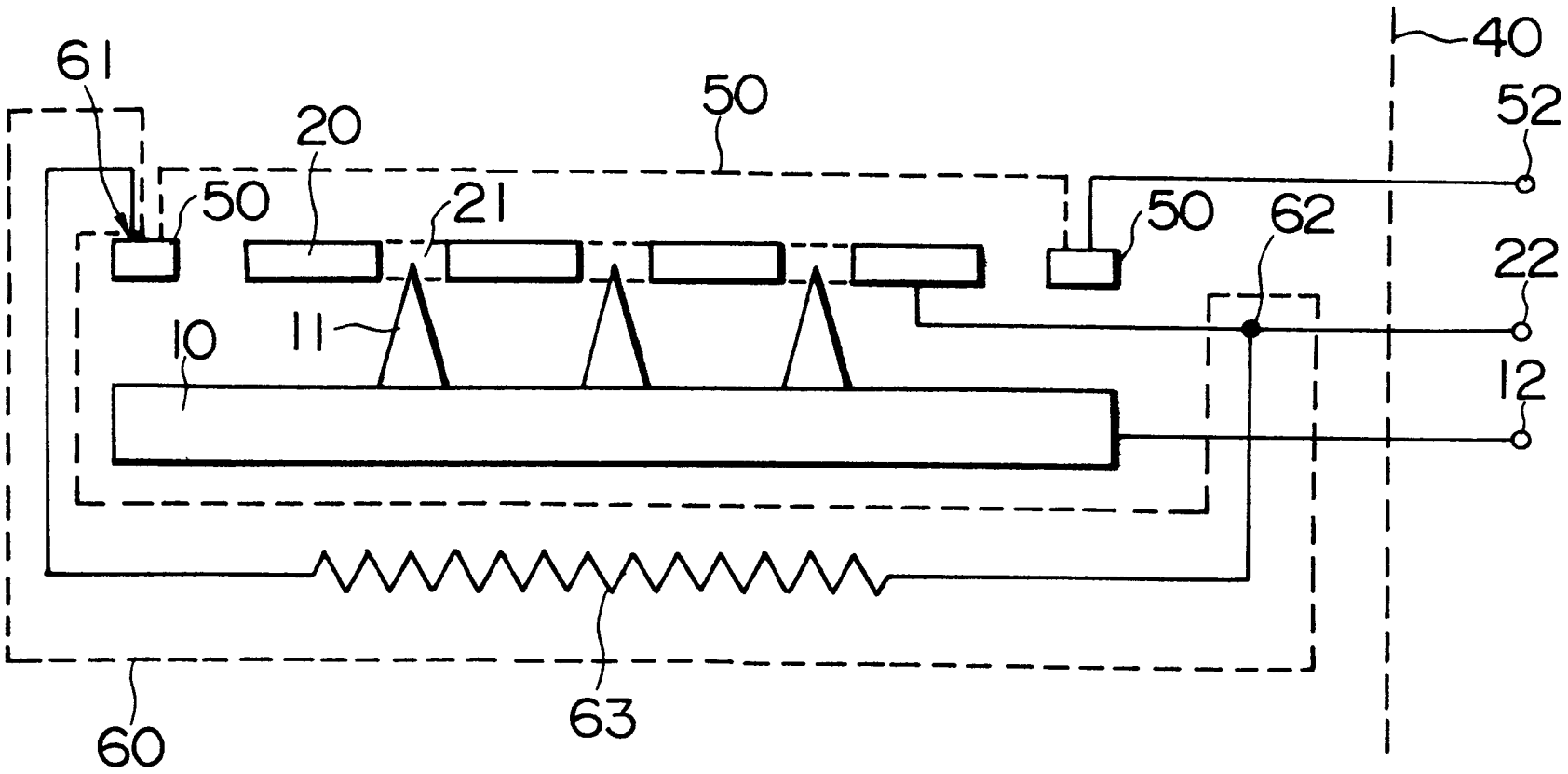
FIG. 22 is a view illustrating a field emission cold cathode apparatus according to the seventh embodiment of the present invention.

Specifically, the illustrated field emission cold cathode apparatus has a silicon substrate 100, an insulator layer 71 on the silicon substrate 100, a resistor layer as a resistor 33, and the plurality of the emitters 11 arranged on the area corresponding to the emitter area of the resistor layer. In the illustrated example, the resistor layer also serves to restrict a current flowing into the emitters 11. As shown in FIG. 22, the resistor layer is formed on the insulator layers 71 and also serves as a resistor 33 which is operable as a part of the heater 30*e*.

Herein, it may be said that a combination of the silicon substrate 100, the resistor layer, and the plurality of the emitters 11 are operable as the emitter electrode 10.

The resistor 33 has two resistor ends 13, 32 supports the emitter area thereon. The resistor end 13 is connected to the heater terminal 35 through a contact 74 formed through the insulator layer 73 while resistor end 32 is connected to the emitter terminal 12 through another contact 74 also formed through the insulator layer 73.

In this structure, when a voltage is given between the heater terminal 35 and the emitter terminal 12, a current flows into the resistor 33 located under the emitters 11, and heats the resistor 33.

Referring to FIG. 22, a field emission cold cathode apparatus according to the seventh embodiment of this invention is featured in that two connection ends 61, 62 are electrically connected in common to a gate terminal 22 and an focus terminal 52, respectively. Detail description about this embodiment will be made below.

The field emission cold cathode apparatus illustrated in FIG. 22 comprises an emitter electrode 10, a gate electrode 20, a focus electrode 50, and a heater 60.

The emitter electrode 10 has a plurality of emitters 11, each employing a needle-like apex, such as a conical shape, and is connected to an emitter terminal 12 extended to the outside of a receptacle including all elements of the apparatus, like in the above first embodiment. The emitter electrode 10 is supplied through the emitter terminal 12 with a negative potential relative to a gate potential given to the gate electrode 20, when electrons are emitted from the emitters 11.

The gate electrode 20 has a plurality of holes 21 utilized to generate a high electric-field at the tips of emitters 11 and is connected to a gate terminal 22 extended to the outside of the device. The gate electrode 20 is supplied with the gate potential as a reference potential through the gate terminal 22, as illustrated in conjunction with the first embodiment. Further, the gate electrode 20 is supported above the emitter electrode 10 by a insulator layer (not shown) interposed between the gate and the emitter electrodes 20 and 10.

The focus electrode 50 surrounds the gate electrode 20 and is connected to a focus terminal 52. The focus electrode 50 is supplied with a negative potential relative to the gate potential, namely, the reference potential through the focus terminal 52. The focus electrode 50 is helpful to suppress expansion of the electron beams extracted from the emitters 11 by the gate electrode 20.

The heater 60 has two connection ends 61, 62 and a resistor 63 located between the two connection ends 61, 62. The connection end 61 is connected to the focus electrode 50 while the connection end 62 is connected in common to the gate terminal 22. In order to achieve a good focusing effect, it is desirable that a resistance value of the resistor 63 is determined, so that the focus electrode 50 is preferably substantially kept at a constant potential as a whole and a predetermined quantity of heat is obtained by suitably adjusting resistance of the focus electrode 52.

The illustrated apparatus can also reduce the number of terminal in comparison with the conventional apparatus having a heater.

This embodiment is not restricted to the above-mentioned structure. For example, the heater 60 brings about the desired effect on condition that the heater is located in the element and is connected to the others within the element, but the heater may be located on the outside of the element. FIG. 22 shows a general idea of this embodiment and the heater 60 may be placed at a location where the heater 60 can heat the emitters 11, like in the first embodiment. The focus electrode 50 may have a plurality of holes and may be located above the gate electrode 20 with another insulator layer interposed between the focus electrode 50 and the gate electrode 20, though the focus electrode illustrated in FIG. 22 is placed on the same layer as the gate electrode 20.

Moreover, this apparatus may comprises a diode which is located between the two connection ends 61, 62 and which is connected in series to the resistor 63, if a voltage pulse is given by a voltage supplying unit to emit electrons. In that case, a cathode of the diode serves as one of the connection ends 62 and is connected in common to the gate terminal 22 while an anode of the diode is connected to one side of the resistor 63. Further, another side of the resistor 63 serves as another connection ends 61 and is connected to the focus electrode 50. In the apparatus of this type, the heating operation and the focusing operation can be controlled independently of each other, by using, as a voltage supplying unit, a bipolar-voltage supplying unit connected between the gate terminal 22 and the focus terminal 52. Thus, the focus operation is performed during emission of electrons while the heater is driven no emission of electrons.

Figure 23:
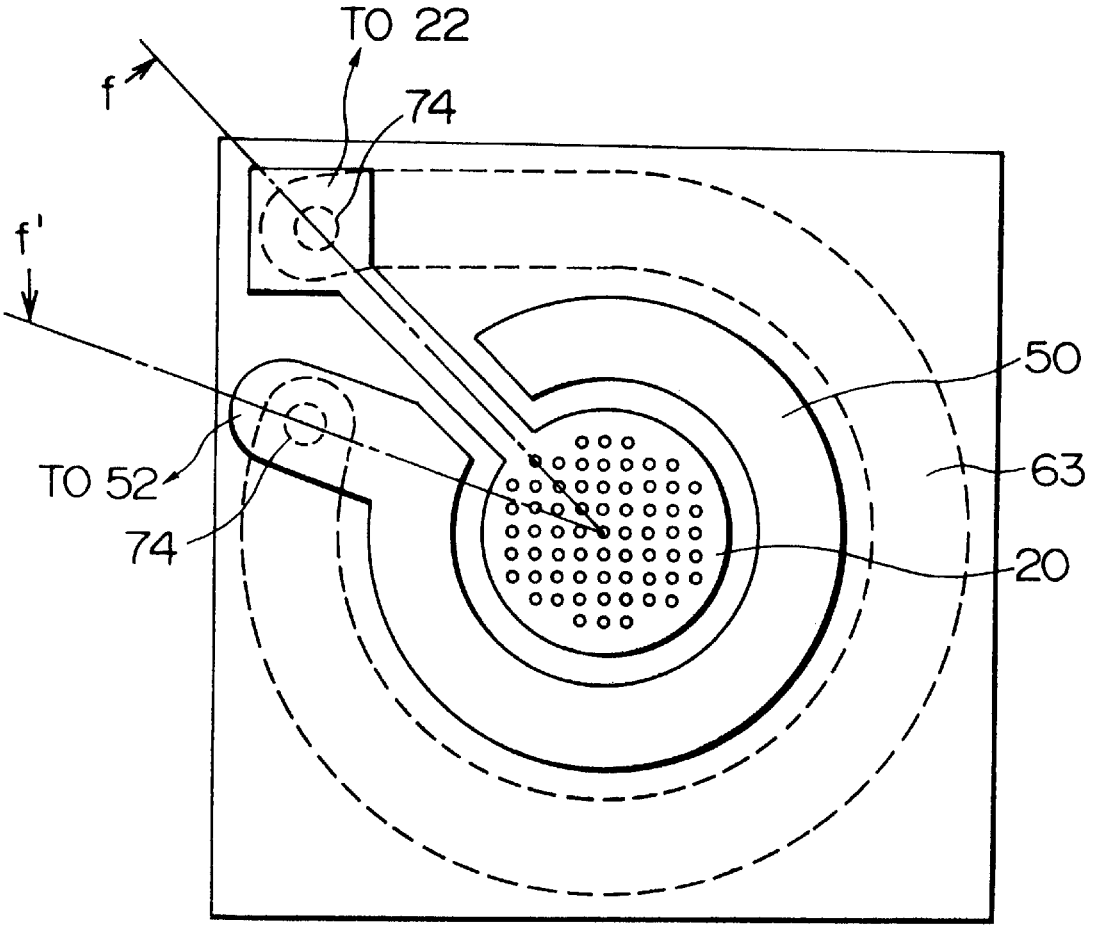
FIG. 23 is a plan view illustrating a concrete structure of the field emission cold cathode apparatus shown in FIG. 22.
Figure 24:
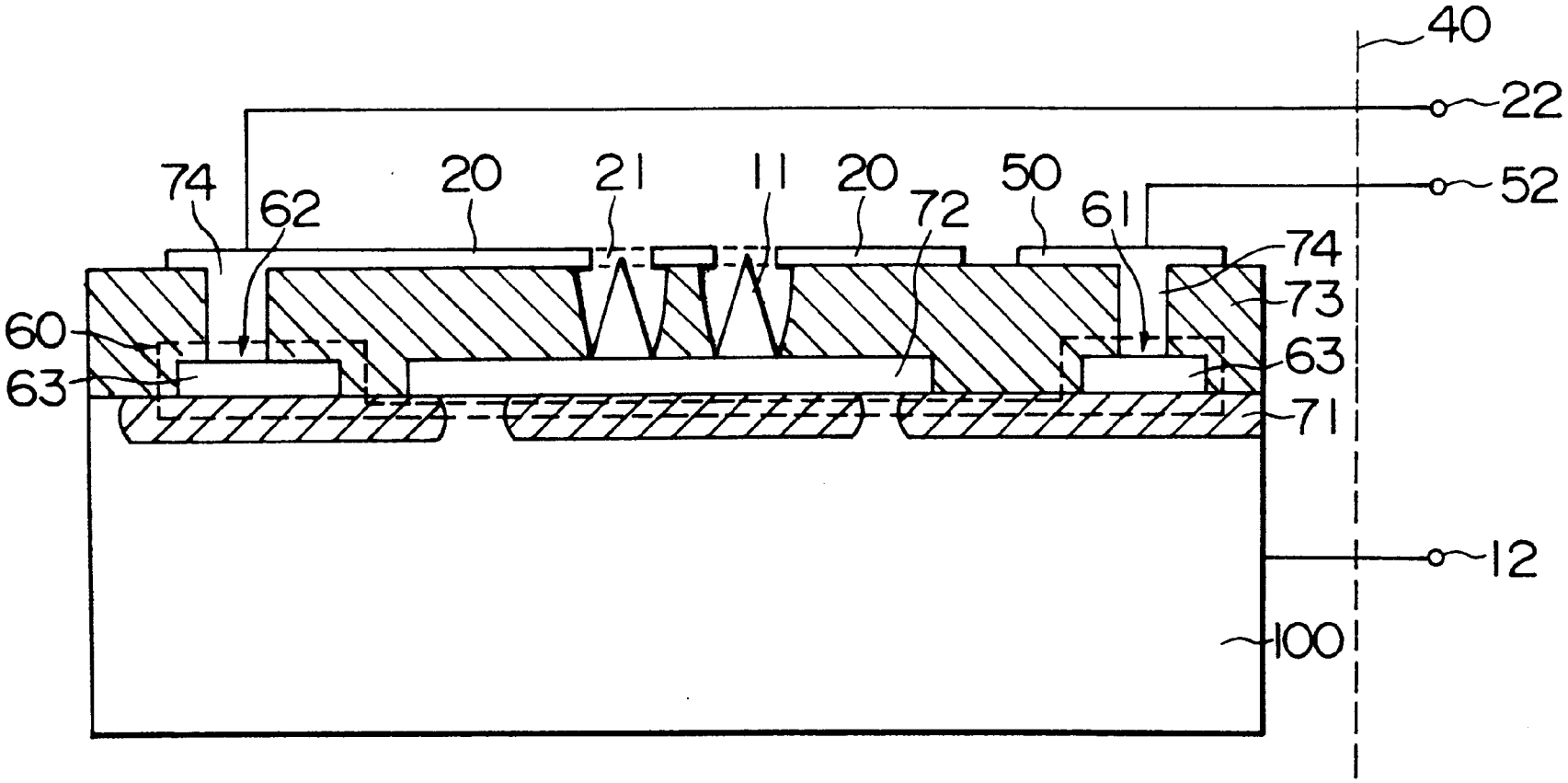
FIG. 24 is a cross-sectional view taken along the line f–f• of FIG. 23.

Referring to FIGS. 23 and 24, specific description will be made about a structure of this embodiment in detail.

In FIGS. 23 and 24, the heater 60 is placed within an element which is structured by the emitters 11, the gate electrode 20, and the focus electrode 50.

This field emission cold cathode apparatus has a silicon substrate 100 and insulator layers 71 each of which is selectively formed in a predetermined part of the silicon substrate 100, as shown in FIG. 24.

Like in the other embodiments, the field emission cold cathode apparatus further has a resistor layer 72 operable to restrict a current flowing into the emitters 11, and the plurality of the emitters 11 on the resistor layer 72. The resistor layer 72 overlies both the insulator layers 71 and a part of the silicon substrate 100. This shows that a voltage is also impressed on the resistor layer 72 through the part of the silicon substrate 100. The silicon substrate 100, the resistor layer 72, and the plurality of the emitters 11 may be collectively called the emitter electrode 10 like in the other embodiments.

In FIG. 24, the heater 60 comprises the resistor 63 which has two resistor ends operable as two connection ends of the heater 60 and which is located on the insulator layer 71. The illustrated resistor 63 surrounds an emitter area which includes the emitters 11. One resistive end, namely, one connection end 61 of the heater 60 is connected to the focus electrode 50 through the contact 74 formed through an insulator layer 73 supporting the focus electrode 50 and the gate electrode 20. While another connection end 62 is connected to the gate electrode 20 through another contact 74 formed through the insulator layer 73.

In this structure, when a predetermined voltage is supplied between the gate electrode 22 and the focus electrode 52, a current flows into the resistor 63 surrounding the outer periphery of the emitter area to heat the resistor 63.

Further, the resistor 63 can be located on a position closer to the emitter area, because the resistor 63 is formed on a layer different from that of the focus electrode 50, though the above description is restricted to the case that the resistor 63 is farther from the emitter area than the position right under the focus electrode 50. For example, the resistor 63 may be located below the focus electrode 50.

Figure 25:
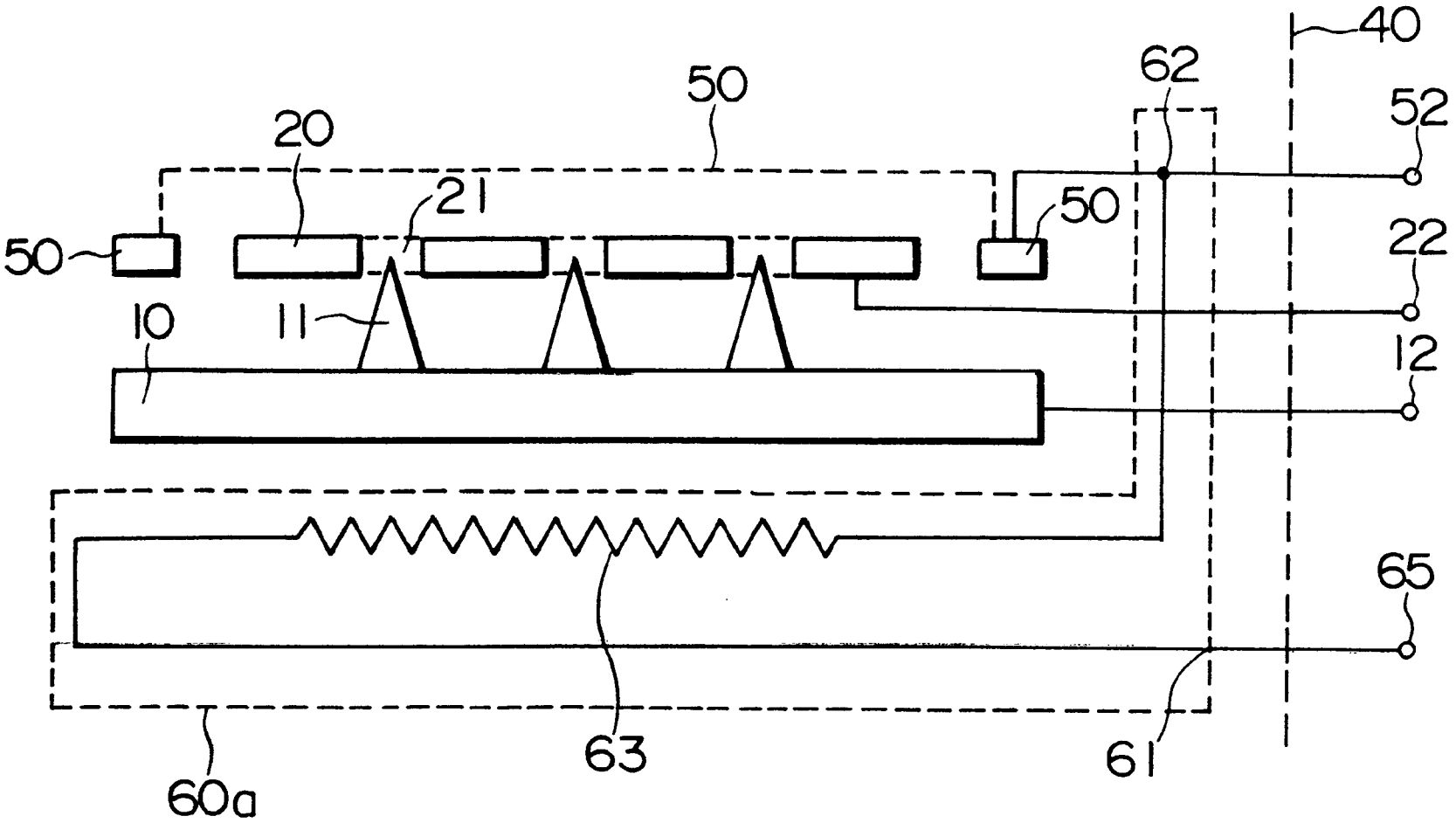
FIG. 25 is a view illustrating a field emission cold cathode apparatus according to the eighth embodiment of the present invention.

Referring to FIG. 25, a field emission cold cathode apparatus according to the eighth embodiment of this invention is similar in structure to that illustrated in conjunction with the seventh embodiment except that one connection end 61 of a heater 60*a* is connected to a heater terminal 65.

Specifically, the field emission cold cathode apparatus according to this embodiment has the heater 60*a* separated from the emitter electrode 10 and the heater terminal 65 extracted from the heater 60*a*. The illustrated heater 60*a* has two connection ends 61, 62. The connection end 61 is connected to the heater terminal 65 while, the connection end 62 is connected in common to the focus terminal 52 through a point of connection between the resistor 63 and the focus electrode 50.

In the field emission cold cathode apparatus having the above structure, a negative potential is given between the focus terminal 52 and the emitter terminal 12 relative to a gate potential given to the gate electrode 20. During the focusing operation and the emission of electrons, the heater terminal 65 is supplied with a predetermined potential to provide a voltage between the heater terminal 65 and the focus terminal 52 and to heat the resistor 63.

Figure 26:
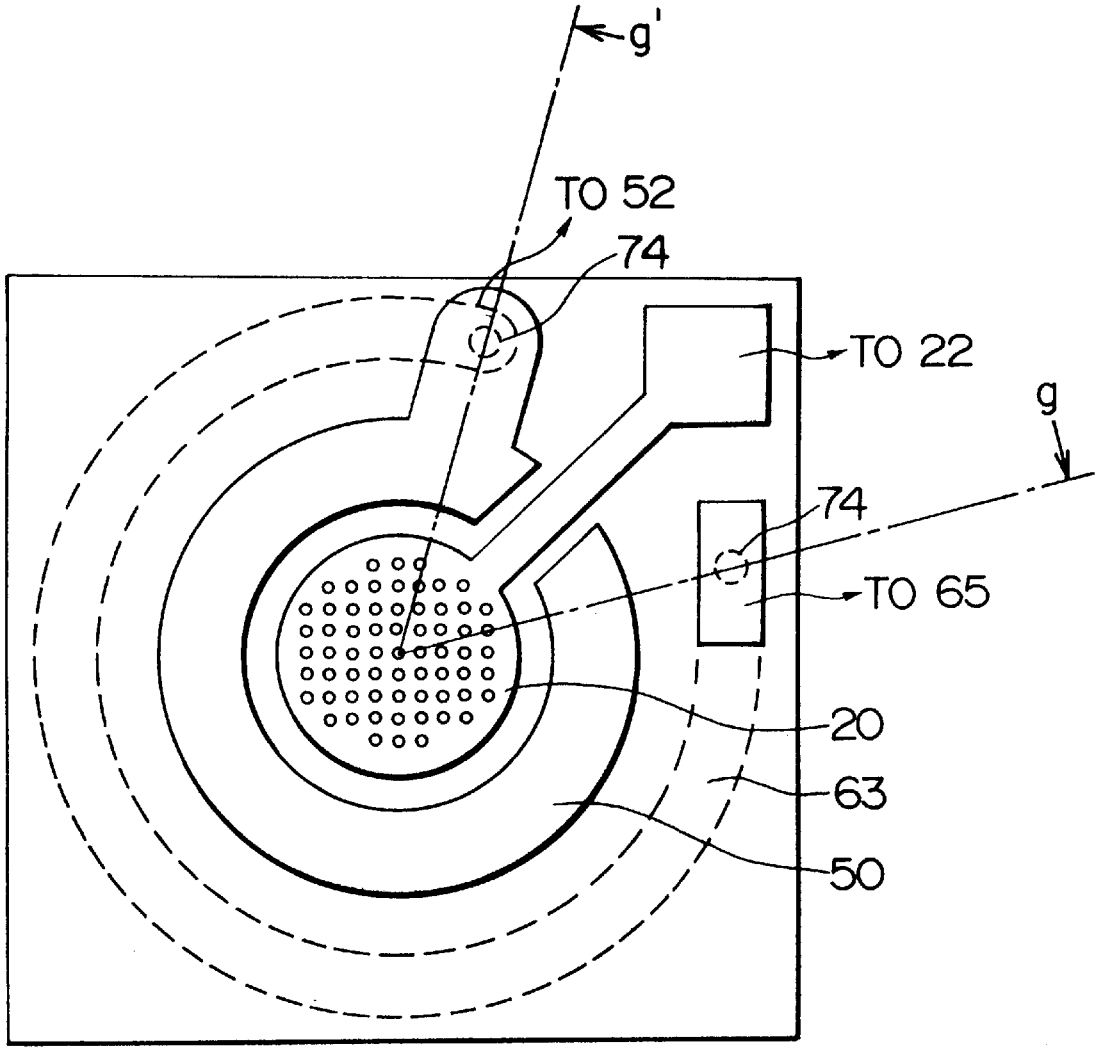
FIG. 26 is a plan view illustrating a concrete structure of the field emission cold cathode apparatus shown in FIG. 25.
Figure 27:
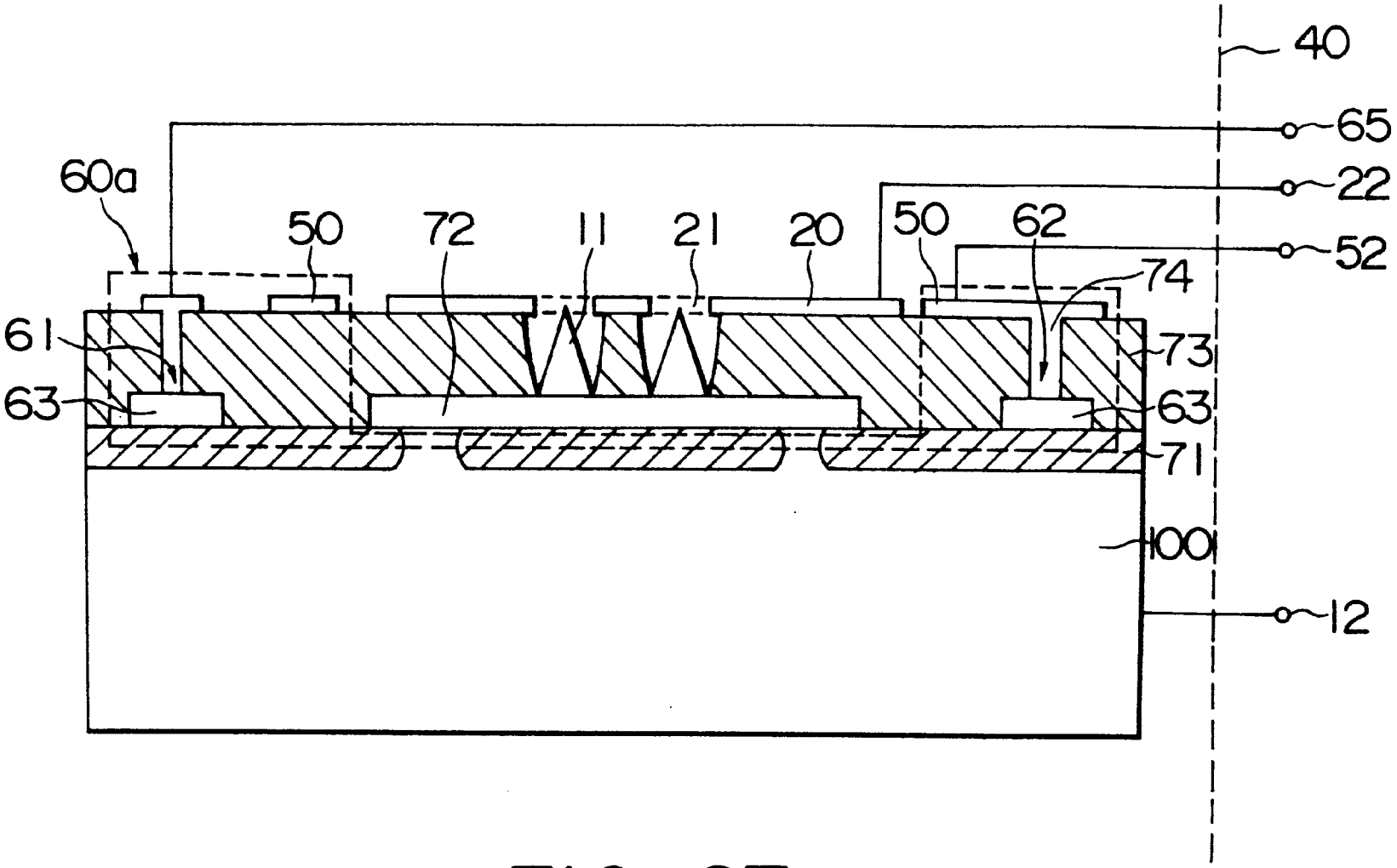
FIG. 27 is a cross-sectional view taken along the line g–g• of FIG. 26.

Referring to FIGS. 26 and 27, specific description will be made about a structure of this embodiment in detail.

In FIGS. 26 and 27, the heater 60*a* (FIG. 27) is arranged within an element including the emitters 11, the gate electrode 20, and the focus electrode 50.

This field emission cold cathode apparatus has a silicon substrate 100 and insulator layers 71 each of which is formed on a predetermined part of the silicon substrate 100.

This field emission cold cathode apparatus further has a resistive layer 72 and the plurality of the emitters 11 on the resistive layer 72. The resistive layer 72 serves to restrict a current flowing into the emitters 11, like the third embodiment and is laid not only the insulator layers 71 but also on a part of the silicon substrate 100. The resistor layer 72 is supplied with a voltage through the part of the silicon substrate 100 connected to the resistor layer 72. Taking the above units consideration, it may be said that a combination of the silicon substrate 100, the resistive layer 72, and the plurality of the emitters 11 is operable as the emitter electrode 10.

The heater 60*a* comprises the resistor 63 which is formed on the insulator layer 71 and which surrounds the outer periphery of the resistor layer 72. The resistor 33 has two resistor ends as two connection ends of the heater 60*a*. The resistor end, namely, the connection end 62 is connected to the focus electrode 50 supported by an insulator 73 through the contact 74 formed through the insulator layer 73. On the other hand, another resistor end, namely, another connection end 61 is connected to the heater terminal 65 through another contact formed through the insulator 73.

In this structure, also when a predetermined voltage is given between the heater terminal 65 and the focus terminal 52, the current flows into the resistor 63 surrounding the emitter area (including the resistor layer 72 and the emitters 11), to heat the resistor 33.

Further, the resistor 63 can be located on a position closer to the emitter area, because the resistor 63 is formed at a position different from a position right under the focus electrode 50, like in the seventh embodiment.

Figure 28:
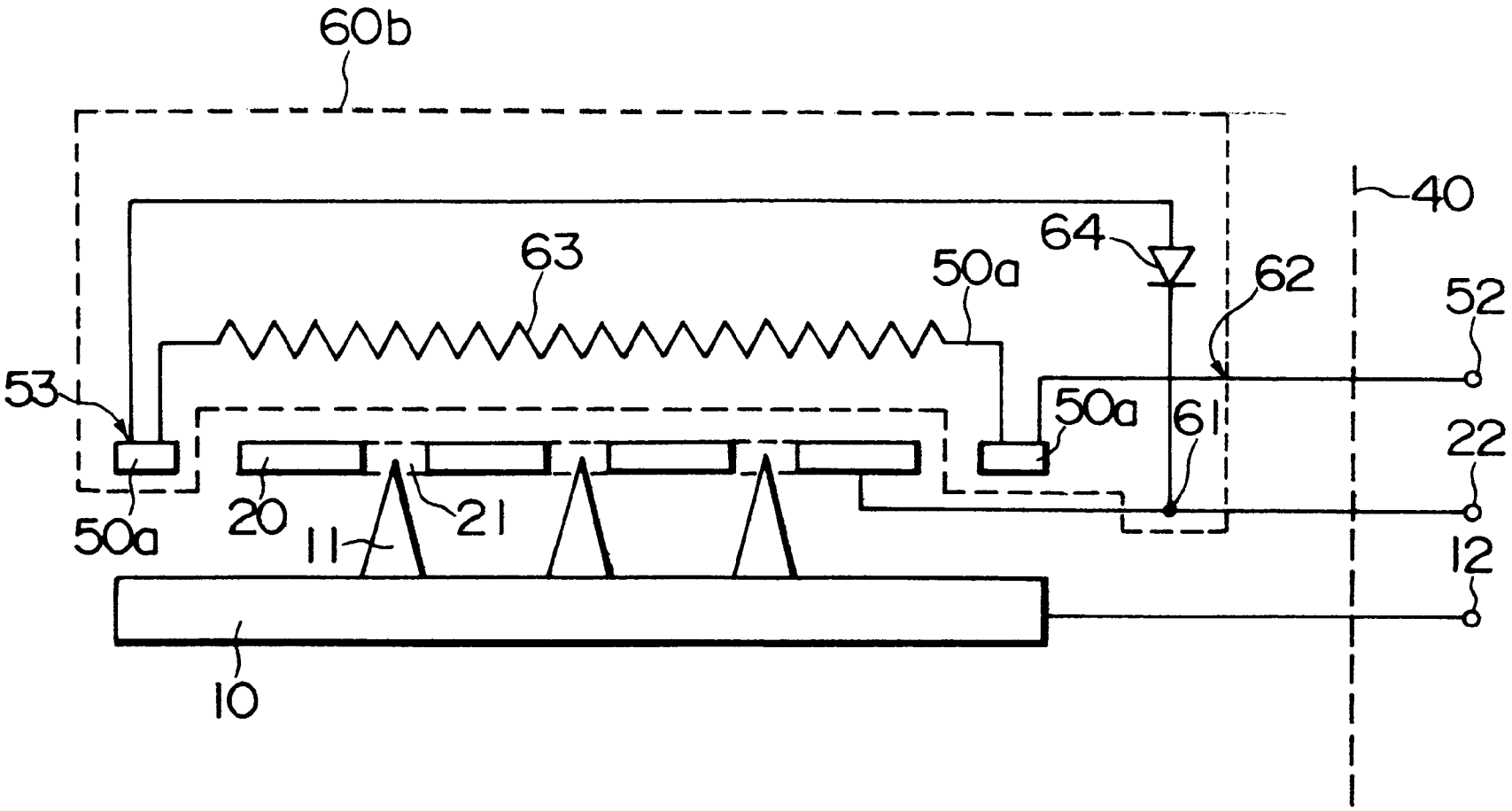
FIG. 28 is a view illustrating a field emission cold cathode apparatus according to the ninth embodiment of the present invention.

Referring to FIG. 28, a field emission cold cathode apparatus according to the ninth embodiment of this invention is similar in structure to that of the seventh embodiment except that a heater 60*b* is connected to the focus electrode 50*a*.

More specifically, the field emission cold cathode apparatus according to this embodiment is featured in that a part of the focus electrode 50*a* is operable as a part of a resistor 63 and that the heater 60*b* includes the part of the focus electrode 50*a* and the resistor 63 in a manner as illustrated in FIG. 28.

More in detail, the heater 60*b* has the resistor 63, a diode 64, and two connection ends 61, 62. The resistor 63 and the diode 64 are located between the two connection ends 61, 62. The diode 64 is connected in series to the resistor 63. A cathode of the diode 64 is connected to the gate terminal 22 through the connection ends 61 while an anode of the diode 64 is connected to the focus electrode 50*a* at a point 53 shown in FIG. 28. Another connection end 62 is positioned within a connection path between the one side of the focus electrode 50*a* and the focus terminal 52.

Figures 29A, 29B:
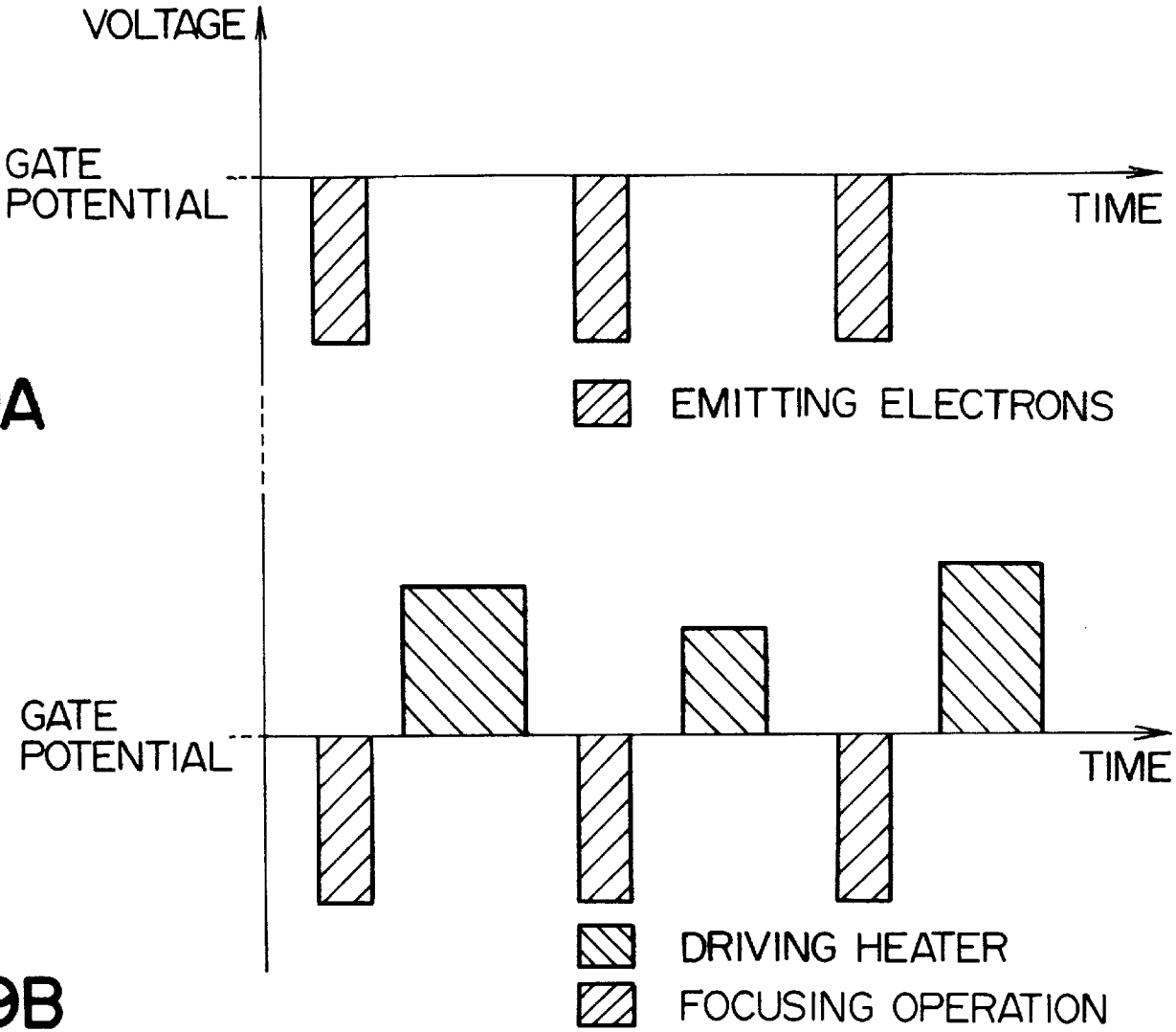
FIGS. 29A and 29B are graph views illustrating variations of voltage value from the gate electrode to the emitter electrode and to the focus electrode, respectively, in shown FIG. 28.

To drive the field emission cold cathode apparatus of this embodiment, voltages are supplied with the emitter terminal 12 and the focus terminal 52, respectively, in the form of voltage pulses as shown in FIGS. 29A and 29B. As shown in FIG. 29A, each pulse, which is hatched by lines slanted upwards an the right-hand side of this figure, serves to emit the electrons from the emitter 11. In FIG. 29B, each positive pulse, which is hatched by lines slanted downwards on the right-hand side of this figure and which has a positive polarity relative to the gate potential, serves to heat the heater 60*b*, while each a negative pulse, which is shaded with a line slanted toward upper right to lower left and which has a negative polarity relative to the gate potential, serves to suppress the expansion of the electron beams extracted by the gate electrode 20. Further, shapes of the pulses and intervals among the pulses may be determined by conditions of emitting electrons and focusing operation, and the like. Thus, the shapes and the intervals may not be restricted to those illustrated in FIGS. 29A and 29B.

The field emission cold cathode apparatus illustrated in FIG. 28 has the same effect as that of the fifth embodiment does, because a part of the focus electrode is formed by a resistor material and the heater includes the part of the focus electrode as the resistor.

As mentioned above and shown in FIG. 29B, the focus terminal 52 is supplied with the negative potential relative to the gate potential, when the focus electrode 50 suppresses the expansion of the electron beams. Then, the diode 64 is kept in an off-state and, therefore, no voltage difference, namely, no distribution of the potential takes place in the focus electrode 50, even though the part of the focus electrode 50 is made from resistive material.

Figure 30:
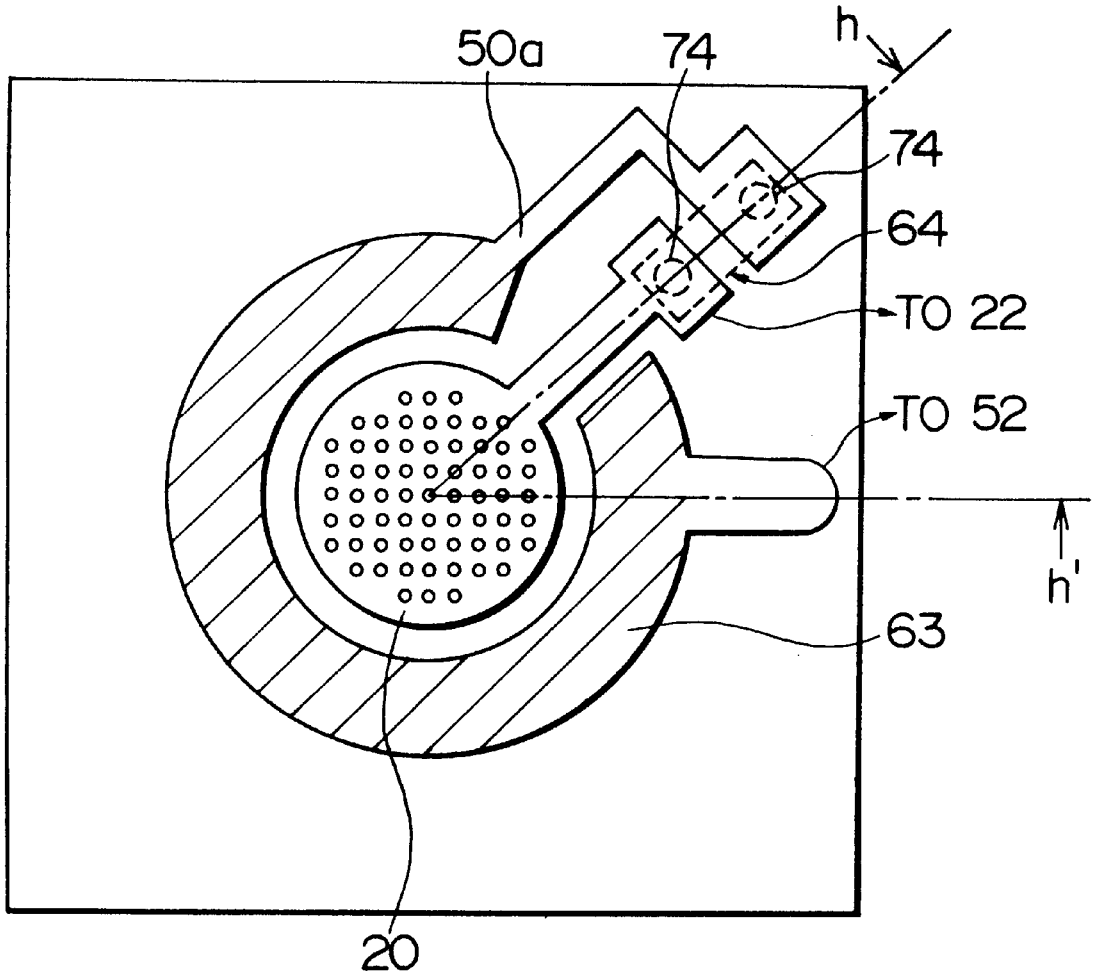
FIG. 30 is a plan view illustrating a concrete structure of the field emission cold cathode apparatus shown in FIG. 28.
Figure 31:
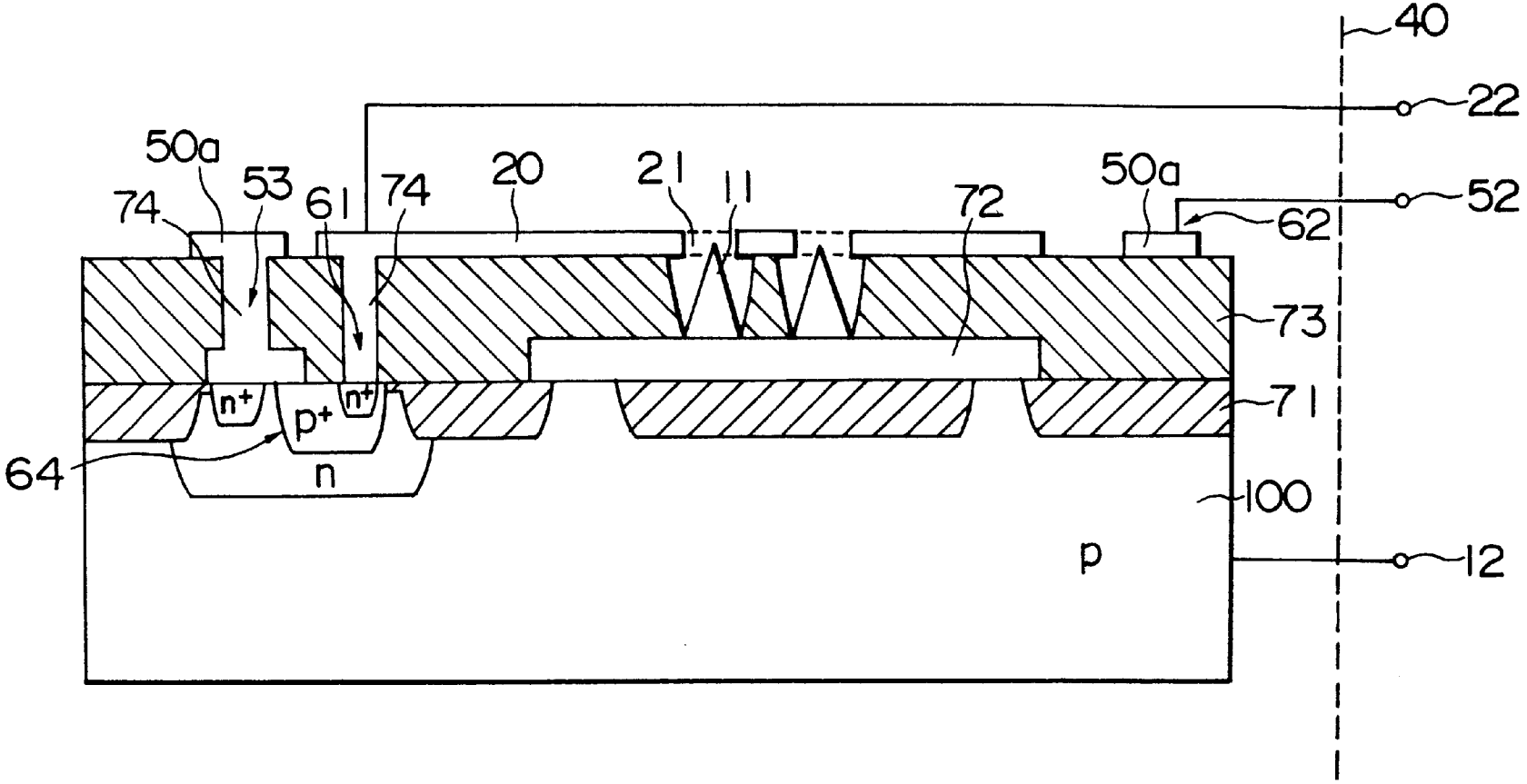
FIG. 31 is a cross-sectional view taken along the line h–h• of FIG. 30.

Referring to FIGS. 30 and 31, description will be made about a structure of this embodiment in detail.

In FIGS. 30 and 31, the heater has the resistor part (63 FIG. 30) operable as the focus electrode 50*a* and the diode 64. The resistor part 63 and the diode 64 are arranged within an element which includes the emitters 11, the gate electrode 20, the focus electrode 50.

In FIG. 31, the field emission cold cathode apparatus has a silicon substrate 100 of a p-type and insulator layers 71 each of which is formed on a predetermined part of the silicon substrate 100. The silicon substrate 100 includes an n-type region as an isolation region. And, $p^+$-region and $n^+$-region are formed in the n-type region. An additional $n^+$-region is formed in the $p^+$-region to constitute the diode 64. The $n^+$-region and the additional $n^+$-region have high (density of impurities) concentration in order to provide ohmic contacts. The $p^+$-region and the $n^+$-region are connected to the focus electrode 50*a* through a contact 74 formed in an insulator layer 73 which supports the focus electrode 50*a* and the gate electrode 20 over of the emitter electrode. The additional $n^+$-region is connected to the gate electrode 20 through another contact 74 formed in the insulator layer 73.

This field emission cold cathode apparatus further has a resistor layer 72 and the plurality of the emitters 11 on the resistor layer 72. The resistor layer 72 overlies the insulator layers 71 and the silicon substrate 100, and restricts a current flowing into the emitters 11. A voltage is impressed on the resistor layer 72 through the part of the silicon substrate 100, as mentioned before. The silicon substrate 100, the resistor layer 72, and the plurality of the emitters 11 may be collectively referred to as the emitter electrode 10.

In the illustrated example, the heater comprises the part of the focus electrode 50*a* as the resistor 63 and the diode 64.

With this structure, a first one of negative potentials is supplied to the emitters 11 and effective to emit the electrons from the emitters 11 while the a second one of the negative potentials is supplied to the focus electrode and effective to suppress the expansion of the electron beams. It is desirable that an absolute value of the first negative potential is greater than another absolute value of the second negative potential. This is because a leak current flows into the focus electrode 50*a* from the emitter electrode, if the absolute value of the first negative potential is smaller than another absolute value of the second negative potential.

In this structure, when the focus terminal 52 is supplied with the positive potential relative to the gate potential, the diode 64 is turned on and then a current flows into the resistor 63 located above the emitters 11 to heat the resistor 63.

Figure 32:
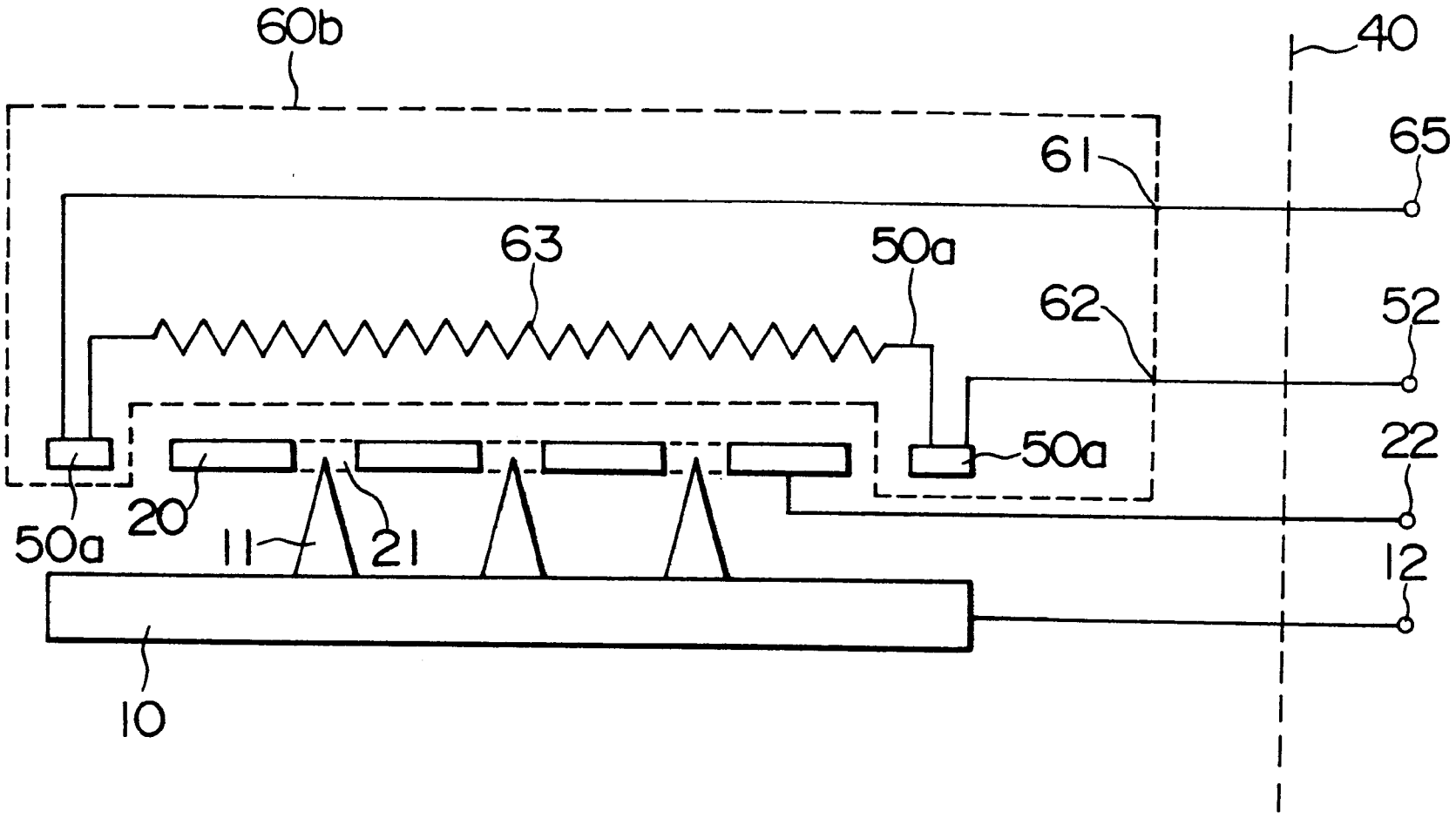
FIG. 32 is a view illustrating a field emission cold cathode apparatus according to the tenth embodiment of the present invention.

Referring to FIG. 32, a field emission cold cathode apparatus according to the tenth embodiment of this invention is similar in structure to that of the ninth embodiment except that no diode is included in the apparatus shown in FIG. 32.

The illustrated field emission cold cathode apparatus is featured by a focus electrode 50*a* a part of which is made from a resistor material and which serves as a resistor 63 of a heater 60*b*. In addition, a focus terminal 65 is extracted from the focus electrode 50*a*.

More particularly, the heater 60*b* has the resistor 63 formed by the part of the focus electrode 50*a* and two connection ends 61, 62. The part of the focus electrode 50*a*, namely, the resistor 63 is located between the two connection ends 61, 62. The connection end 62 is connected in common to the focus terminal 52 together with the focus electrode 50*a*. This shows that the connection end 62 is located within a connection path between the one side of the focus electrode 50*a* and the focus terminal 52. On the other hand. The connection end 61 is connected to the heater terminal 65 extended to the outside of a receptacle which envelopes the illustrated apparatus.

Figures 33A, 33B:
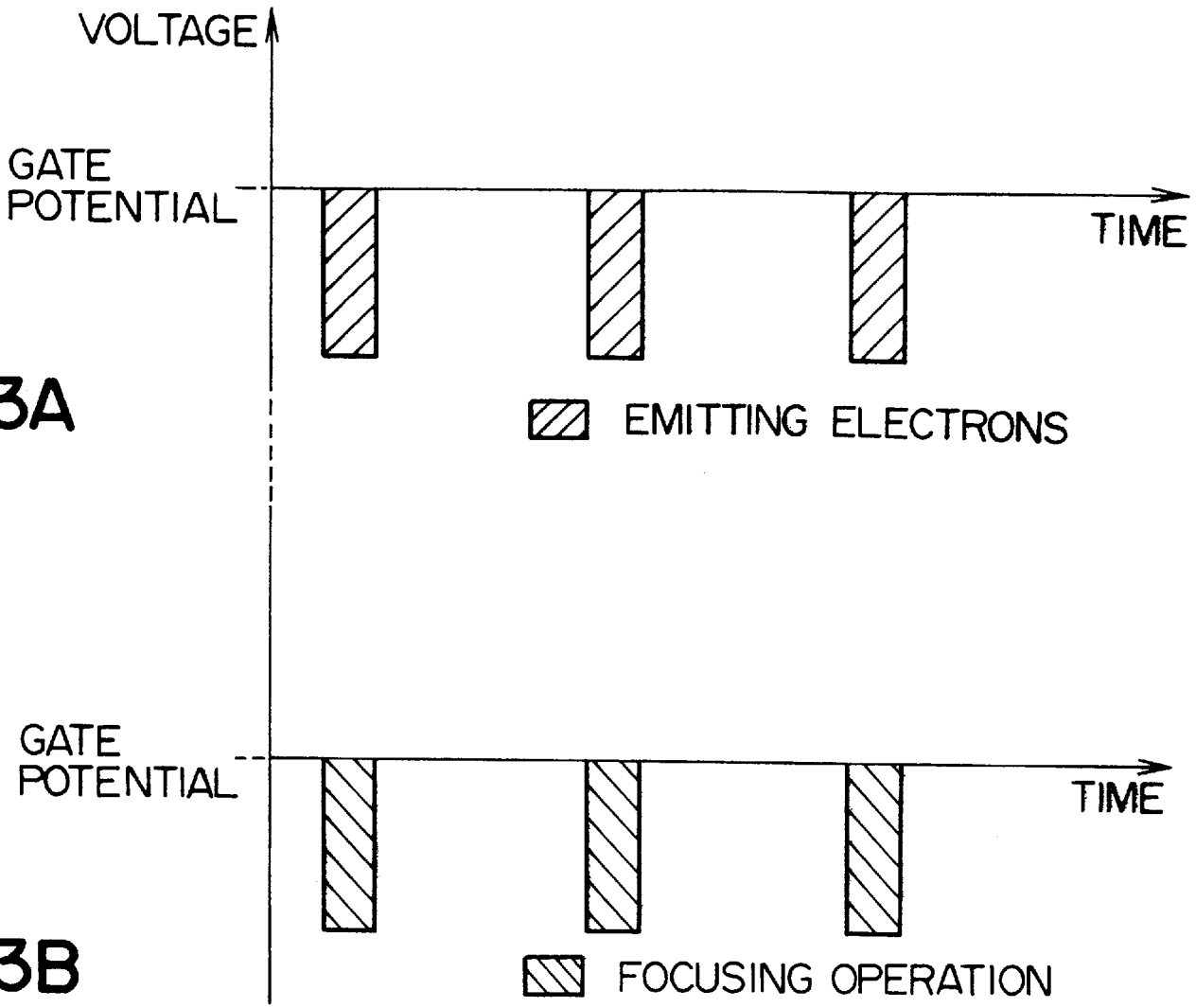
FIGS. 33A and 33B are graph views illustrating variations of voltage value from the gate electrode to the emitter electrode and to the focus electrode, respectively, in shown FIG. 32.

To drive the field emission cold cathode apparatus of this embodiment, voltages are supplied with the emitter terminal 12 and the focus terminal 52, respectively, in the form of voltage pulses as shown in FIGS. 33A and 33B. As shown in FIG. 33A, each pulse, which is hatched by lines slanted upwards on the right-hand side of this figure, serves to emit the electrons from the emitter 11. In FIG. 33 B, each positive pulse, which is hatched by lines slanted downwards on the right-hand side of this figure and which has a negative polarity relative to the gate potential, serves to suppress the expansion of the electron beams extracted by the gate electrode 20. Further, shapes of the pulses and intervals among the pulses may be determined by conditions of emitting electrons and focusing operation, and the like. Thus, the shapes and the intervals may not be restricted to those illustrated in FIGS. 33A and 33B.

Thus, the electron beams is focused by the focus electrode 50*a* at the time when the electron beams are emitted from the emitter electrode, by simultaneously supplying the emitter electrode 10 and the focus electrode 50 with the negative potentials. The heater terminal 65 is continuously supplied with a predetermined potential. Due to a difference of voltages between the predetermined potential and a potential given to the focus terminal 52, the resistor 63 is heated, and then the gradient of the potential is alleviated in the focus electrode 50*a*. As the gradient becomes sharp, the focus operation becomes worse. Therefore, a shape and an arrangement of the heater should be selected.

Figure 34:
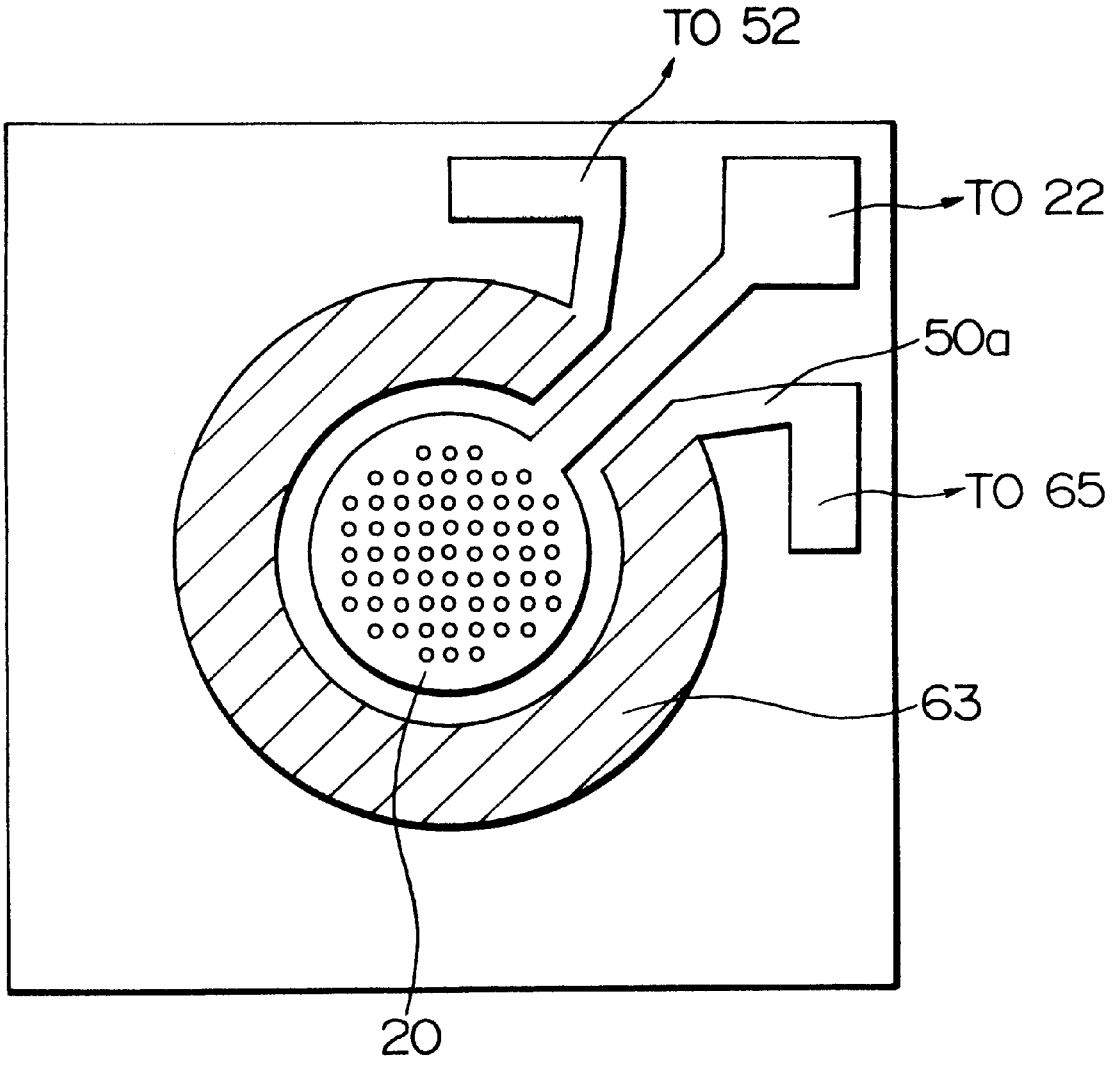
FIG. 34 is a plan view illustrating a concrete structure of the field emission cold cathode apparatus shown in FIG. 32.

Referring to FIG. 34, a structure of this embodiment will be described in detail.

In FIG. 34, the heater has the diode (not shown in this figure) and the resistor part (63) formed in the focus electrode 50*a*. An element which includes the emitters, the gate electrode, and the focus electrode is arranged within the resistor part 63.

In other words, the focus electrode 50*a* surrounds the outer periphery of the gate electrode 20 and has the resistor 63 as a part thereof. And the focus electrode 50*a* has two electrode-ends. One of the electrode-ends is connected to the focus terminal 52 while the remaining electrode-edges is connected to the heater terminal 65.

In this structure, when a predetermined voltage is applied between the focus terminal 52 and the heater terminal 65, a current flows into the resistor 63 located on and above the outer periphery of the emitters 11 to heat the resistor 63.

Examples will be mentioned about materials which are available for the components, each of the electrodes, and so on, in the above first through tenth embodiments.

Materials of the emitter are classified into two groups on the basis of a difference of the manufacturing methods.

One of the methods utilizes a release layer in forming the emitters. Specifically, after an insulator, the gate electrode and etc. Are formed on the substrate, holes are formed therein, and the release layer is formed by depositing its material at a shallow angle for aperture of the holes. Then, the emitters have needle-like points or apexes. In this event, the emitter may be formed by Mo, TiC, ZrC, Ni, TiN, ZrN, and the like.

Another one of the fabrication method makes use of an under-etching process to form the emitters. In this case, an oxide film or a nitride film is formed on a substrate (or a metal layer formed thereon), the oxide or the nitride film is etched into a predetermined pattern, and then the substrate is subjected to an under-etched process to form the predetermined pattern. As a result, the emitters each of which has a needle-like apex are formed. In this event, the emitter formed by Si and Ta formed on the Si substrate.

Materials of the gate electrode and the focus electrode may be selected from a group consisting of W, Mo, and $WSi_2$.

Materials of the insulator, interposed between the emitter electrode and the gate electrode, may be, for example, $SiO_2$ and $Si_3N_4$, and so on.

Materials of the resistor may be, for example, poly-silicon which has low (density of impurities) concentration and which is formed by deposition process, such as CVD.

What is claimed is:

1. A field emission cold cathode apparatus, comprising:

an emitter electrode including a plurality of emitters each of which has a needle-like apex, respectively;

an emitter terminal electrically connected to said emitter electrode;

a gate electrode, supplied with a potential different from that of said emitter electrode, for extracting electron beams from each of said emitters;

a gate terminal electrically connected to said gate electrode;

heating means, which has two connection ends, for heating said emitters by impressing a voltage across said two connection ends, with a selected one of said two connection ends electrically connected in common to either one of said emitter terminal and said gate terminal.

2. A field emission cold cathode apparatus as claimed in claim 1, wherein said emitter electrode, said gate electrode, and said heating means form a cold cathode element.

3. A field emission cold cathode apparatus as claimed in claim 1, wherein:

said emitter electrode and said gate electrode are operable as a part of a cold cathode element;

said field emission cold cathode apparatus further comprising:

a fixing structure for fixing said cold cathode element thereon, said fixing structure being formed by said emitter terminal, said gate terminal, and said heating means, with one of said two connection ends electrically connected to said emitter terminal and with the remaining one of said two connection ends electrically connected to said gate terminal.

4. A field emission cold cathode apparatus as claimed in claim 1, wherein said heating means comprises resistor means located between said two connection ends.

5. A field emission cold cathode apparatus as claimed in claim 4, wherein said resistor means has a resistor region formed in said emitter electrode.

6. A field emission cold cathode apparatus as claimed in claim 4, wherein said resistor means, which has two resistor ends, has a resistor layer closer to said emitter electrode than said gate electrode, with the plurality of the emitters surrounded by the resistor means.

7. A field emission cold cathode apparatus as claimed in claim 4, wherein said heating means further comprises a diode connected in series to said resistor means, with both of said diode and said resistor means located between said two connection ends.

8. A field emission cold cathode apparatus as claimed in claim 7, wherein:

said emitter electrode comprises a semiconductor region which is formed in a semiconductor substrate and from which said plurality of the emitters are projected;

said resistor means, which has two resistor ends, is formed on a layer which is close to said emitter electrode and which is remote from said gate electrode, with said plurality of the emitters surrounded by said resistor means; and said diode, which has two terminals, is installed within said semiconductor substrate, with a selected one of said two terminals connected to one of said two resistive ends.

9. An electron-emitting device comprising a cold cathode element, a fixing structure for fixing said cold cathode element, and a power supply source, wherein:

said cold cathode comprises an emitter electrode and a gate electrode, said emitter electrode having a plurality of emitters each of which has an apex while said gate electrode is supplied with a potential different from that of said emitter electrode to extract electron beams from each of said emitters;

said fixing structure has an emitter terminal electrically connected to said emitter electrode, a gate terminal electrically connected to said gate electrode, and heating means, which has two connection ends, for heating said emitters by impressing a voltage between said two connection ends, with a selected one of said two connection ends connected to said emitter terminal and with the remaining one of said two connection ends connected to said gate terminal;

said power supply source supplies a bipolar voltage between said emitter terminal and said gate terminal.

10. An electron-emitting device as claimed in claim 9, wherein said bipolar voltage generated by said power supply source has a polarity, an amplitude, and a pulse width which are all controlled so as to adjust a temperature of the heating means.

11. An electron-emitting structure comprising a field emission cold cathode apparatus and power supply source, wherein:

said field emission cold cathode apparatus has an emitter electrode, an emitter terminal, a gate electrode, a gate terminal, and heating means, said emitter electrode having a plurality of emitters which have apexes, respectively, said emitter terminal being electrically connected to said emitter electrode, said gate electrode being supplied with a potential different than that of said emitter electrode to extract electron beams from each of said emitters, said gate terminal being electrically connected to said gate electrode, said heating means having two connection end and heating said plurality of the emitters by impressing a voltage between said two connection ends to heat said plurality of emitters up, a selected one of said two connection ends connected in common to said emitter terminal while the remaining one of said two connection ends connected in common to said gate terminal;

said power supply source generates a bipolar voltage and supplies the same between said emitter terminal and said gate terminal.

12. An electron-emitting structure as claimed in claim 11, wherein power supply source generates a bipolar voltage which has a polarity, a pulse width, and an amplitude which are adjusted to control a temperature of the emitters.

13. A field emission cold cathode apparatus, comprising:

an emitter electrode including a plurality of emitters which have apexes, respectively;

an emitter terminal electrically connected to said emitter electrode;

a gate electrode, supplied with a potential different from that of said emitter electrode, for extracting electron beams from each of said emitters;

a gate terminal electrically connected to said gate electrode;

a focus electrode, supplied with a potential different from that of said gate electrode, for focusing said electron beams extracted by gate electrode;

a focus terminal electrically connected to said focus electrode:

heating means, which has two connection ends, for heating said emitters by impressing a voltage across said two connection ends, with a selected one of said two connection ends electrically connected in common to either one of said gate terminal and said focus terminal.

14. A field emission cold cathode apparatus as claimed in claim 13, wherein said emitter electrode, said gate electrode, said focus electrode, and said heating means form a cold cathode element.

15. A field emission cold cathode apparatus as claimed in claim 13, wherein said heating means comprises resistor means located between said two connection ends.

16. A field emission cold cathode apparatus as claimed in claim 15, wherein said resistor means, which has two resistor ends, has a resistor layer closer to said emitter electrode than said gate electrode, with the plurality of the emitters surrounded by the resistor means.

17. A field emission cold cathode apparatus as claimed in claim 15, wherein said heating means further comprises a diode connected in series to said resistor means, with both of said diode and said resistor means located between said two connection ends.

18. A field emission cold cathode apparatus as claimed in claim 17, wherein:

said emitter electrode comprises a semiconductor region which is formed in a semiconductor substrate and which said plurality of the emitters are projected;

said resistor means, which has two resistor ends, is formed on a layer which is close to said emitter electrode and which is remote from said gate electrode, with said plurality of the emitters surrounded by;

said diode, which has two terminals, is set up within said semiconductor substrate, with a selected one of said two terminals connected to one of said two resistive ends.

19. A field emission cold cathode apparatus as claimed in claim 17, wherein said focus electrode comprises two electrode-ends, with a selected one of two electrode-ends connected to said focus terminal and with the remaining one of said two electrode-ends connected to one of said two connection ends.

20. A field emission cold cathode apparatus as claimed in claim 19, wherein said resistor means has a predetermined resistance value to keep a voltage between the two electrode-ends substantially constant.

21. A field emission cold cathode apparatus as claimed in claim 19, wherein the remaining one of said two connection ends is connected in common to said gate electrode.

22. A field emission cold cathode apparatus as claimed in claim 14, wherein:

said resistor means has a resistor region formed in said focus electrode;

one of said two connection ends is connected in common to said focus terminal.

23. A field emission cold cathode apparatus as claimed in claim 22, wherein the remaining one of said two connection ends is connected in common to said gate terminal.

24. A field emission cold cathode apparatus as claimed in claim 22, wherein said heating means further comprises a diode connected in series to said resistor means.

25. A field emission cold cathode apparatus as claimed in claim 24, wherein said diode has a cathode connected in common to said gate terminal and an anode connected to said resistor means.

26. A field emission cold cathode apparatus as claimed in claim 25, wherein:

said emitter electrode comprises a semiconductor substrate;

said diode is formed within said semiconductor substrate.

27. An electron-emitting structure comprising a field emission cold cathode apparatus and a power supply source, wherein:

said field emission cold cathode apparatus has an emitter electrode, an emitter terminal, a gate electrode, a gate terminal, a focus electrode, a focus terminal, and heater element, said emitter electrode having a plurality of emitters which have apexes, respectively, said emitter terminal being electrically connected to said emitter electrode, said gate electrode being supplied with a potential different from that of said emitter electrode to extract electron beams from each of said emitters, said gate terminal being electrically connected to said gate electrode, said focus electrode being supplied with a potential different from that of said gate electrode to focus said electron beams extracted by said gate electrode, said focus terminal being electrically connected to said focus electrode, said heater element having two connection ends and heating the plurality of the emitters by impressing a voltage between said two connection ends, a selected one of said two connection ends being connected in common to either one of said gate terminal and said focus terminal;

said power supply source supplying a bipolar voltage between said gate terminal and said focus terminal.

28. An electron-emitting structure as claimed in claim 27, wherein said power supply source generates the bipolar voltage which is varied in a polarity, a pulse width, an amplitude.

* * * * *

UNITED STATES PATENT AND TRADEMARK OFFICE

CERTIFICATE OF CORRECTION

PATENT NO. : 5,994,833
DATED : November 30, 1999
INVENTOR(S) : Nobuya Seko, et. al.

It is certified that error appears in the above-identified patent and that said Letters Patent is hereby corrected as shown below:

Col. 1, line 51, delete "no" insert --so--.

Col. 1, line 58, delete "sate" insert --gate--.

Col. 6, line 23, delete "agate" insert --a gate--.

Col. 6, line 63, delete "agate" insert --a gate--.

Col. 7, line 14, delete "23" insert --33--.

Col. 9, line 24, delete "sate" insert --gate--.

Col. 18, line 54, delete "an" insert --on--.

Col. 20, line 14, delete "hand. The" insert --hand, the--.

Signed and Sealed this

Fourteenth Day of November, 2000

*Attest:*

Q. TODD DICKINSON

*Attesting Officer*

*Director of Patents and Trademarks*